US009152120B2

(12) United States Patent
Takahashi

(10) Patent No.: US 9,152,120 B2
(45) Date of Patent: Oct. 6, 2015

(54) CLEANING BLADE, PROCESS CARTRIDGE, AND IMAGE FORMING APPARATUS

(71) Applicant: FUJI XEROX CO., LTD., Tokyo (JP)

(72) Inventor: Yoshinori Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 54 days.

(21) Appl. No.: 13/867,419

(22) Filed: Apr. 22, 2013

(65) Prior Publication Data

US 2014/0086656 A1 Mar. 27, 2014

(30) Foreign Application Priority Data

Sep. 25, 2012 (JP) ..... 2012-210546

(51) Int. Cl.
*G03G 21/00* (2006.01)

(52) U.S. Cl.
CPC .... *G03G 21/0011* (2013.01); *G03G 2215/0132* (2013.01)

(58) Field of Classification Search
CPC ..... G03G 21/0011; G03G 21/0017; G03G 2215/0132
USPC ..... 399/350
See application file for complete search history.

(56) References Cited

U.S. PATENT DOCUMENTS

| | | | | |
|---|---|---|---|---|
| 2007/0003337 | A1* | 1/2007 | Shakuto et al. | 399/349 |
| 2007/0140762 | A1* | 6/2007 | Ueno et al. | 399/350 |
| 2009/0029277 | A1* | 1/2009 | Okuda et al. | 430/96 |
| 2014/0086653 | A1* | 3/2014 | Tano et al. | 399/350 |

FOREIGN PATENT DOCUMENTS

JP A-2007-052062 3/2007

* cited by examiner

*Primary Examiner* — Ryan Walsh
*Assistant Examiner* — Philip Marcus T Fadul
(74) *Attorney, Agent, or Firm* — Oliff PLC

(57) ABSTRACT

Provided is a cleaning blade for cleaning a surface of an image holding member, including a contact member that contacts the surface of the image holding member at a corner portion of a tip end of the cleaning blade, wherein, when the position of the corner portion in a state where the image holding member is stopped is set to be a standard, a movement distance of the cleaning blade to the position of the corner portion in a state where the image holding member is driven is from 10 μm to 30 μm.

18 Claims, 8 Drawing Sheets

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-210546 filed Sep. 25, 2012.

BACKGROUND

1. Technical Field

The present invention relates to a cleaning blade, a process cartridge, and an image forming apparatus.

2. Related Art

In the related art, in electrophotographic copier, printer, facsimile and the like, a cleaning blade has been used as a cleaning device for removing residual toner on a surface of an image holding member of a photoreceptor.

SUMMARY

According to an aspect of the invention, there is provided a cleaning blade for cleaning a surface of an image holding member, including a contact member that contacts the surface of the image holding member at a corner portion of a tip end of the cleaning blade, wherein, when the position of the corner portion in a state where the image holding member is stopped is set to be a standard, a movement distance of the cleaning blade to the position of the corner portion in a state where the image holding member is driven is from 10 μm to 30 μm.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail.

Cleaning Blade

A cleaning blade for cleaning a surface of an image holding member according to an exemplary embodiment includes a contact member that contacts the surface of the image holding member at a corner portion of a tip end (hereinafter, referred to as a "contact corner portion") of the cleaning blade. When the position of the contact corner portion in a state where the image holding member is stopped is set to be a standard, a movement distance of the cleaning blade to the position of the contact corner portion in a state where the image holding member is driven is from 10 μm to 30 μm.

Herein, each unit of the cleaning blade will be described. Hereinafter, as shown in FIG. 1, the cleaning blade includes a contact corner portion 3A that cleans the surface of an image holding member 31 by being brought into contact with the image holding member (photoreceptor drum) 31 which is driven, a tip end face 3B in which one side thereof is formed by the contact corner portion 3A and that faces the upstream side in the driving direction (arrow A direction), a belly face 3C in which one side thereof is formed by the contact corner portion 3A and that faces the downstream side in the driving direction (arrow A direction), and a rear face 3D that shares one side with the tip end face 3B and opposes the belly face 3C.

In addition, a direction parallel to the contact corner portion 3A is referred to as a depth direction, a direction from the contact corner portion 3A to the side where the tip end face 3B is formed is referred to as a thickness direction, and a direction from the contact corner portion 3A to the side where the belly face 3C is formed is referred to as a width direction.

Figure 1:
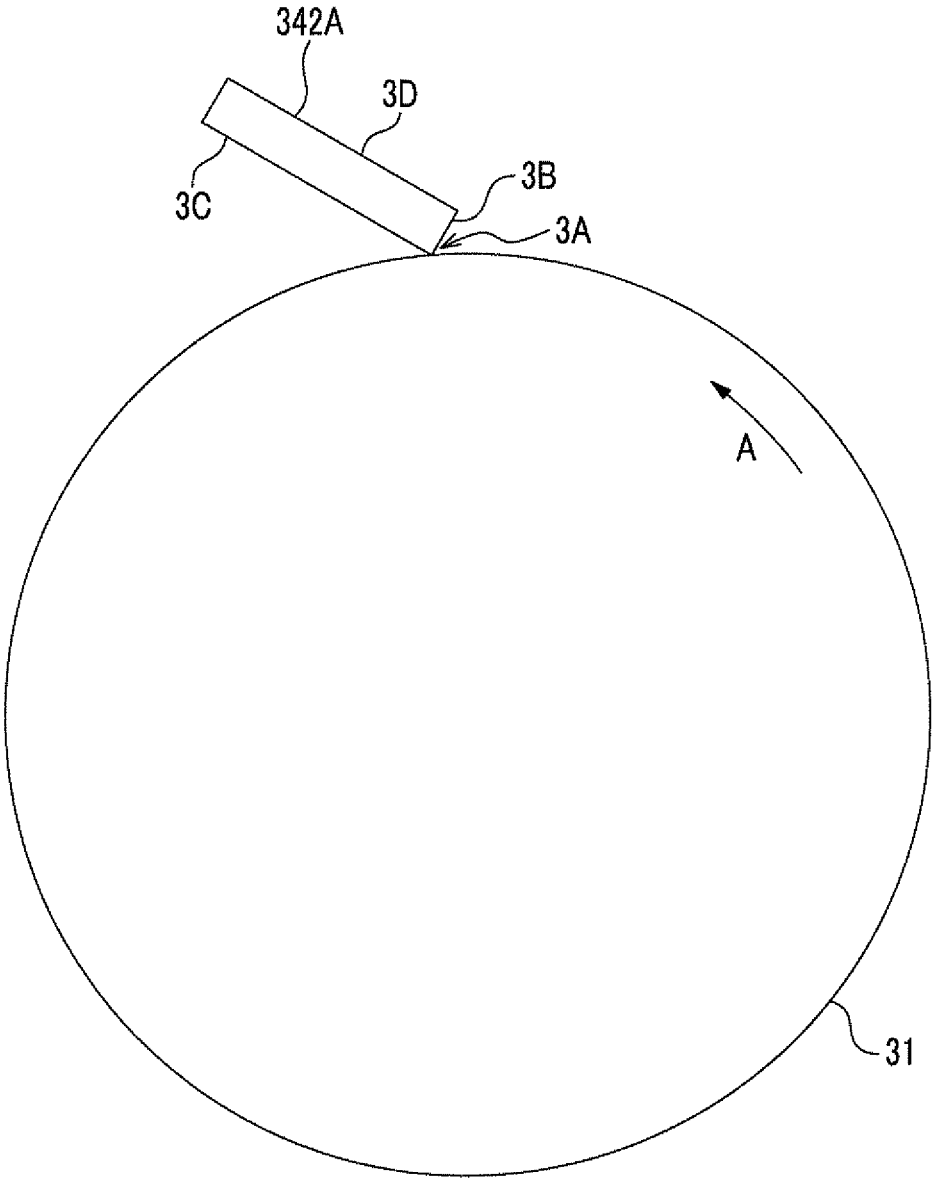
FIG. 1 is a view schematically showing an example of a cleaning blade according to an exemplary embodiment.

Moreover, for the sake of expedience, in FIG. 1, a direction in which the image holding member (photoreceptor drum) 31 is driven is depicted as the arrow A but FIG. 1 shows a state where the image holding member 31 is stopped.

In the related art, there is a case where abrasion occurs at the contact portion of the cleaning blade, which cleans the surface of the image holding member in the image forming apparatus, and the image holding member. The cleaning performance is degraded at portions which are abraded in some cases. Therefore, in the cleaning blade, there is a demand for suppressing abrasion from the viewpoint of being able to be long lasting.

On the other hand, in the cleaning blade according to the exemplary embodiment, the movement distance of the contact corner portion of the cleaning blade and the image holding member is controlled to be in the above-described range. By suppressing the movement distance in a specific range, it is possible to suppress a length of the contact region of the cleaning blade with the image holding member in a driving direction of the image holding member (so-called tack amount). As a result, it is considered that the abrasion of the cleaning blade is suppressed.

Movement Distance

In the cleaning blade according to the exemplary embodiment, when the position of the contact corner portion in a state where the image holding member is stopped is set to be a standard, a movement distance of the cleaning blade to the position of the contact corner portion in a state where the image holding member is driven is from 10 μm to 30 μm.

Figure 2:
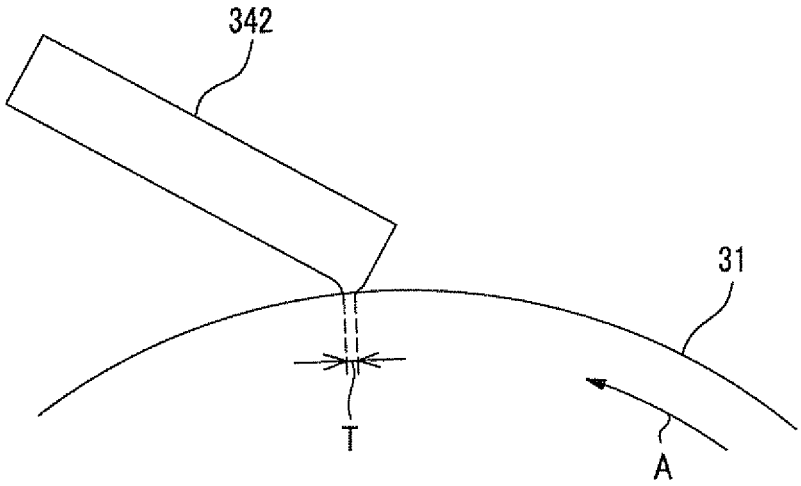
FIG. 2 is a view schematically showing a state where the cleaning blade according to the exemplary embodiment is brought into contact with an image holding member which is driven.

Herein, as shown in FIG. 1 and FIG. 2, when the image holding member (photoreceptor drum) 31 is driven, kinetic friction occurs at the contact portion of the cleaning blade 342 and the image holding member 31 and then involution toward the driving direction of the cleaning blade 342 is generated by the kinetic friction. The movement distance represents a difference ("T" in FIG. 2) between a position of the contact corner portion 3A in a state where the image holding member 31 is not driven as shown in FIG. 1 and a position of the contact corner portion 3A in a state where the image holding member 31 is driven and the involution toward the driving direction (arrow A direction) of the cleaning blade 342 is generated as shown in FIG. 2.

When the movement distance exceeds the above-described upper limit, it is not possible to obtain an abrasion suppression effect of the cleaning blade and the degradation of the cleaning performance of the cleaning blade occurs as time elapses. On the other hand, when the movement distance is less than the above-described lower limit, the cleaning performance of the cleaning blade is not sufficiently maintained.

The movement distance is more preferably from 10 μm to 15 μm.

The movement distance is measured by the following method.

A strain gauge (manufactured by Kyowa Electronic Instruments Co., Ltd., KFG-1-1-20-C1-11-2M2R) is attached to a position separating from a contact corner (3A in FIG. 1) by 1 mm in a central portion in the depth direction of the belly face (3C in FIG. 1) of the cleaning blade. Moreover, using an adhesive (manufactured by Konishi Co., Ltd., Bond AronAlpha), attaching is carried out such that the adhesive does not adhere to the contact corner portion of the cleaning blade. The strain gauge is connected to a dynamic strain measuring device (manufactured by Kyowa Electronic Instruments Co., Ltd., DPM-602B) The cleaning blade is disposed on the surface of the image holding member and then the image holding member is driven, thereby measuring the strain of the cleaning blade before and after driving.

The relationship between the movement distance and the strain is verified in such a manner that when a transparent plate is moved slowly while pressing the cleaning blade to the plate, the movement distance and the strain of the cleaning blade at this time are measured in advance. The movement distance is calculated from the previously verified relationship and the above-described measured strain.

A method of controlling the movement distance is not particularly limited but the following method is exemplified.

For example, as the hardness of a portion of the cleaning blade to be brought into contact with the image holding member is lowered, the movement distance tends to be increased.

In addition, as the frictional force between the cleaning blade and the image holding member is increased, the movement distance tends to be increased.

Moreover, the frictional force is adjusted by a material of the portion of the cleaning blade to be brought into contact with the image holding member, a pressing force of the cleaning blade to the image holding member, a coefficient of friction between the cleaning blade and the image holding member, or the like.

Furthermore, the pressing force is adjusted by a length of the cleaning blade biting into the image holding member, an angle W/A (Working Angle) at the contact portion of the cleaning blade and the image holding member, rebound resilience of the entire cleaning blade, a free length of the cleaning blade, a length of the cleaning blade in a thickness direction thereof, a Young's modulus of the cleaning blade, or the like.

Configuration of Image Forming Apparatus and Process Cartridge

A process cartridge detachable from an image forming apparatus according to an exemplary embodiment includes an image holding member on a surface of which a toner image is formed; and the cleaning blade according to the exemplary embodiment.

Further, an image forming apparatus according to an exemplary embodiment includes an image holding member; a charging device that charges the image holding member; an electrostatic latent image forming device that forms an electrostatic latent image on a surface of a charged image holding member; a developing device that develops the electrostatic latent image formed on the surface of the image holding member using toner to form a toner image; a primary transfer device that transfers the toner image formed on the image holding member to an intermediate transfer member; a secondary transfer device that transfers the toner image that has been transferred to the intermediate transfer member to a recording medium; and the cleaning blade according to the exemplary embodiment.

First, the configurations of the image forming apparatus and the process cartridge in which the cleaning blade according to the exemplary embodiment is applied will be described in detail based on an example thereof using the drawing. Here, the configurations of the image forming apparatus and the process cartridge according to the exemplary embodiment are not limited to the embodiment shown in FIG. 3.

Figure 3:
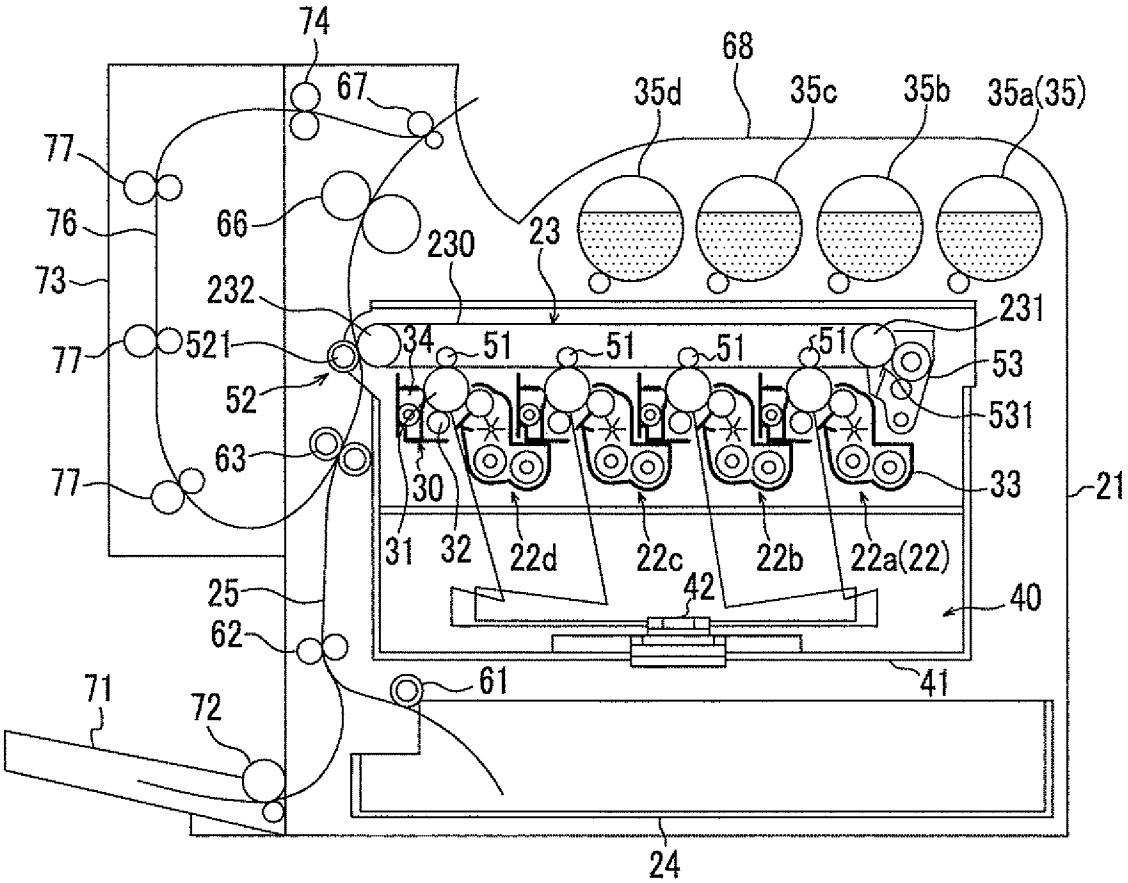
FIG. 3 is a schematic diagram showing an example of an image forming apparatus according to the exemplary embodiment.

FIG. 3 is a schematic diagram showing an example of the image forming apparatus according to the exemplary embodiment and shows a so-called tandem type image forming apparatus.

In FIG. 3, 21 indicates a main body housing; 22 and 22*a* to 22*d* indicate an image forming engine; 23 indicates a belt module; 24 indicates a recording medium supply cassette; 25 indicates a recording medium transport path; 30 indicates each photoreceptor unit; 31 indicates a photoreceptor drum (a kind of image holding members); 33 indicates each developing unit (a kind of developing devices); 34 indicates a cleaning device; 35 and 35*a* to 35*d* indicate a toner cartridge; 40 indicates an exposure unit; 41 indicates a unit case; 42 indicates a polygonal mirror; 51 indicates a primary transfer unit; 52 indicates a secondary transfer unit; 53 indicates a belt cleaning device; 61 indicates a feed roll; 62 indicates a transporting roll; 63 indicates a positioning roll; 66 indicates a fixing apparatus; 67 indicates a discharge roll; 68 indicates a discharge unit; 71 indicates a manual supply device; 72 indicates a feed roll; 73 indicates a double-sided recording unit; 74 indicates a guide roll; 76 indicates a transport path; 77 indicates a transporting roll; 230 indicates an intermediate transfer belt; 231 and 232 indicate a support roll; 521 indicates a secondary transfer roll; and 531 indicates a cleaning blade. Moreover, a transfer apparatus according to the exemplary embodiment is configured to include the primary transfer unit 51, the intermediate transfer belt 230 and the secondary transfer unit 52.

The tandem type image forming apparatus shown in FIG. 3 arranges four color (black, yellow, magenta and cyan in the exemplary embodiment) image forming engines 22 (specifically 22*a* to 22*d*) in the main body housing 21 and disposes the belt module 23 including the intermediate transfer belt 230 circularly transported along the arrangement direction of the respective image forming engines 22 above the engines in FIG. 3. On the other hand, the recording medium supply cassette 24, in which a recording medium (not illustrated) such as paper is housed, is disposed in a lower part of the main body housing 21 in FIG. 3. In addition, a recording medium transport path 25, which is to be a transport path of the recording medium from the recording medium supply cassette 24, is vertically arranged.

In the exemplary embodiment, respective image forming engines 22 (22*a* to 22*d*) form toner images successively from the upstream side in the circulation direction of the intermediate transfer belt 230, for example, toner images for black, yellow, magenta, and cyan (the arrangement is not necessarily in this order), and include each photoreceptor unit 30, each developing unit 33 and a single exposure unit 40 to be used in common.

Herein, the photoreceptor unit 30 is made in a sub cartridge type by integrating, for example, the photoreceptor drum (image holding member) 31, a charging roll (charging device) 32 which previously charges the photoreceptor drum 31, and the cleaning device 34 that removes residual toner on the photoreceptor drum 31.

The developing unit (developing device) 33 develops color toners (for example, negative polarity in the exemplary embodiment) corresponding to electrostatic latent images which are exposed and formed on the charged photoreceptor drum 31 by the exposure unit 40. In addition, a sub cartridge including the photoreceptor unit 30 and the developing unit 33 are integrated with each other to form a process cartridge (so-called Customer Replaceable Unit).

Moreover, in FIG. 3, the reference numeral 35 (35*a* to 35*d*) indicates a toner cartridge for supplying each color component toner to each developing unit 33 (toner supplying paths are not illustrated).

On the other hand, the exposure unit 40 houses, for example, four semiconductor lasers (not illustrated), one polygonal mirror 42, an imaging lens (not illustrated) and respective mirrors (not illustrated) corresponding to the respective photoreceptor units 30 in the unit case 41 and arranges the above-described units so as to carry out deflecting and scanning light from the semiconductor laser for each color component by the polygonal mirror 42 and guide a light image to an exposure point on the corresponding photoreceptor drum 31 through the imaging lens and the mirror.

In the exemplary embodiment, the belt module 23 strides the intermediate transfer belt 230, for example, between a pair of support rolls (one is a driving roll) 231 and 232. The primary transfer unit (in this example, a primary transfer roll) 51 is installed in the rear face of the intermediate transfer belt 230 corresponding to the photoreceptor drum 31 of each photoreceptor unit 30 and a toner image on the photoreceptor drum 31 is electrostatically transferred to the intermediate transfer belt 230 side by applying voltage with opposite polarity to the charge polarity of the toner to the primary transfer unit 51. In addition, the secondary transfer unit 52 is installed at a portion corresponding to the support roll 232 in the downstream side of the image forming engine 22*d* in the most downstream side of the intermediate transfer belt 230 so as to secondarily transfer (collectively transfer) the primary-transferred image on the intermediate transfer belt 230 to the recording medium.

In the exemplary embodiment, the secondary transfer unit 52 includes a secondary transfer roll 521 that is disposed while being pushed to the toner image holding face side of the intermediate transfer belt 230 and a rear face roll (in this example, used as the support roll 232 in common) that is disposed in the rear face side of the intermediate transfer belt 230 and forms a counter electrode of the secondary transfer roll 521. Then, for example, the secondary transfer roll 521 is grounded and bias with the same polarity as the charge polarity of the toner is applied to the rear face roll (support roll 232).

Further, the belt cleaning device 53 is installed in the upstream side of the image forming engine 22*a* in the most upstream of the intermediate transfer belt 230 so as to remove the residual toner on the intermediate transfer belt 230.

In the recording medium supply cassette 24, the feed roll 61 for picking up a recording medium is installed. The transporting roll 62 for sending the recording medium is installed immediately behind the feed roll 61 and a registration roll (positioning roll) 63 for supplying the recording medium to a secondary transfer position at a predetermined timing is installed in the recording medium transport path 25 positioned immediately before the secondary transfer position. On the other hand, the fixing apparatus 66 is installed in the recording medium transport path 25 positioned in the downstream side of the secondary transfer position, the discharge roll 67 for discharging the recording medium is installed in the downstream side of the fixing apparatus 66 and the discharged recording medium is housed in the discharge unit 68 formed in an upper part of the main body housing 21.

In the exemplary embodiment, the manual supply device (MSI) 71 is installed in a side of the main body housing 21 and a recording medium on the manual supply device 71 is sent toward the recording medium transport path 25 by the feed roll 72 and the transporting roll 62.

In addition, the double-sided recording unit 73 is attached to the main body housing 21. When the double side mode in which images are recorded on both sides of the recording medium is selected, the double-sided recording unit 73 takes the recording medium subjected to recording in one face in the inside by reversely rotating the discharge roll 67 and using the guide roll 74 in front of the inlet; transports the recording medium positioned in the inside along with the recording medium return transport path 76 by the transporting roll 77; and supplies the recording medium to the positioning roll 63 side again.

Cleaning Device

Next, the cleaning device 34 installed in the inside of the tandem type image forming apparatus shown in FIG. 3 will be described in detail.

Figure 4:
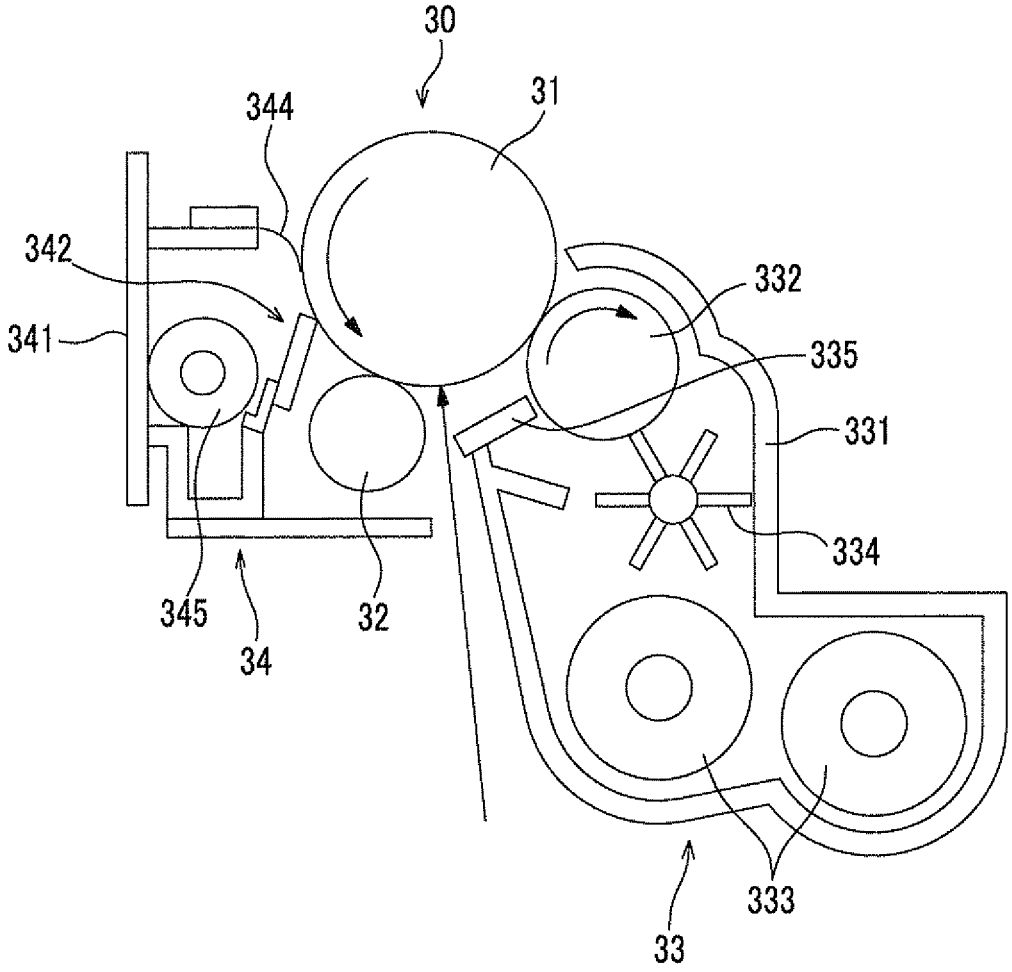
FIG. 4 is a cross-sectional view schematically showing an example of a cleaning device according to the exemplary embodiment.

FIG. 4 is a cross-sectional view schematically showing an example of a cleaning device according to the exemplary embodiment and showing the photoreceptor drum 31, the charging roll 32 and the developing unit 33 which are integrated as a process cartridge together with the cleaning device 34 shown in FIG. 3.

In FIG. 4, 32 indicates a charging roll (charging device); 331 indicates a unit case; 332 indicates a development roll; 333 indicates a toner transport member; 334 indicates a transport paddle; 335 indicates a trimming member; 341 indicates a cleaning case; 342 indicates a cleaning blade; 344 indicates a film seal; and 345 indicates a transport member.

The cleaning device 34 includes the cleaning case 341 that houses residual toner therein and has an opening on the opposite to the photoreceptor drum 31. The cleaning blade 342 which is disposed to be in contact with the photoreceptor drum 31 is attached to the lower rim of the opening of the cleaning case 341 by a bracket (not illustrated in the drawing). On the other hand, the film seal 344 for closing a gap between the upper rim of the opening of the cleaning case 341 and the photoreceptor drum 31 air-tightly is attached to the upper rim of the opening of the cleaning case 341. In addition, the reference numeral 345 denotes the transport member that leads the used toner housed in the cleaning case 341 to a used toner container in the lateral side thereof.

In the exemplary embodiment, the cleaning blade according to the exemplary embodiment is used as a cleaning blade in all cleaning devices 34 of the respective image forming engines 22 (22*a* to 22*d*). In addition, FIG. 4 shows a state where the cleaning blade 342 is fixed directly to the frame member in the cleaning device 34. However, the fixing state thereof is not limited thereto and the cleaning blade 342 may be fixed thereto by a spring material.

Next, the configuration of the cleaning blade according to the exemplary embodiment will be described.

When the position of the contact corner portion in a state where the image holding member is stopped is set to be a standard, a movement distance of the cleaning blade according to the exemplary embodiment to the position of the contact corner portion in a state where the image holding member is driven is from 10 μm to 30 μm.

In this specification, a member, which forms a region including a portion of the cleaning blade to be brought into contact with the image holding member, is referred to as a "contact member". That is, the cleaning blade according to the exemplary embodiment may be formed only of the contact member.

In addition, when the contact member of the cleaning blade is formed of a different material from that of a region other than the contact member, a member forming the region other than the contact member is referred to as a "non-contact member". The non-contact member may be formed of one kind of material or two or more kinds of members containing different materials.

Hereinafter, the configuration of the cleaning blade according to the exemplary embodiment will be described in detail using the drawings. FIG. 1 is a view schematically showing a cleaning blade according to a first exemplary embodiment and showing a state where the cleaning blade is brought into contact with the surface of the photoreceptor drum. In addition, FIG. 5 is a view showing a state where a cleaning blade according to a second exemplary embodiment is brought into contact with the surface of the photoreceptor drum and FIG. 6 is a view showing a state where a cleaning blade according to a third exemplary embodiment is brought into contact with the surface of the photoreceptor drum.

A cleaning blade 342A according to the first exemplary embodiment shown in FIG. 1 is formed of a single material, including a portion to be brought into contact with the photoreceptor drum 31, that is, a contact corner portion 3A, as a whole. That is to say, the cleaning blade 342A is formed only of the contact member.

Figure 5:
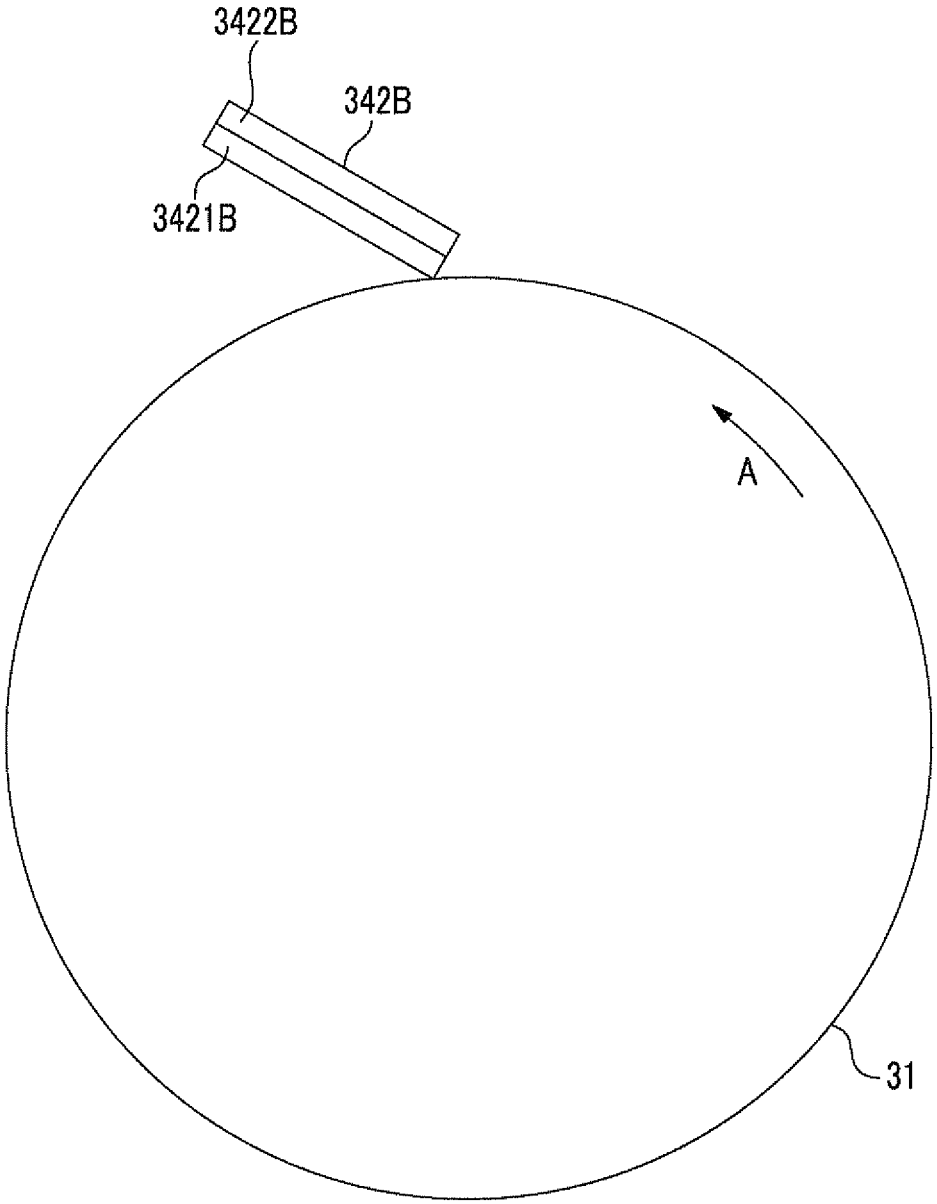
FIG. 5 is a view schematically showing another example of the cleaning blade according to the exemplary embodiment.

In a similar way to the second exemplary embodiment shown in FIG. 5, the cleaning blade according to the exemplary embodiment may have a two-layer structure in which a first layer 3421B and a second layer 3422E are provided. The first layer 3421B includes the portion to be brought into contact with the photoreceptor drum 31, that is, the contact corner portion 3A and is formed over the entire face of the belly face 3C side and formed of the contact member. The second layer 3422E is formed on the rear face 3D side from the first layer and formed of a different material from that of the contact member.

Figure 6:
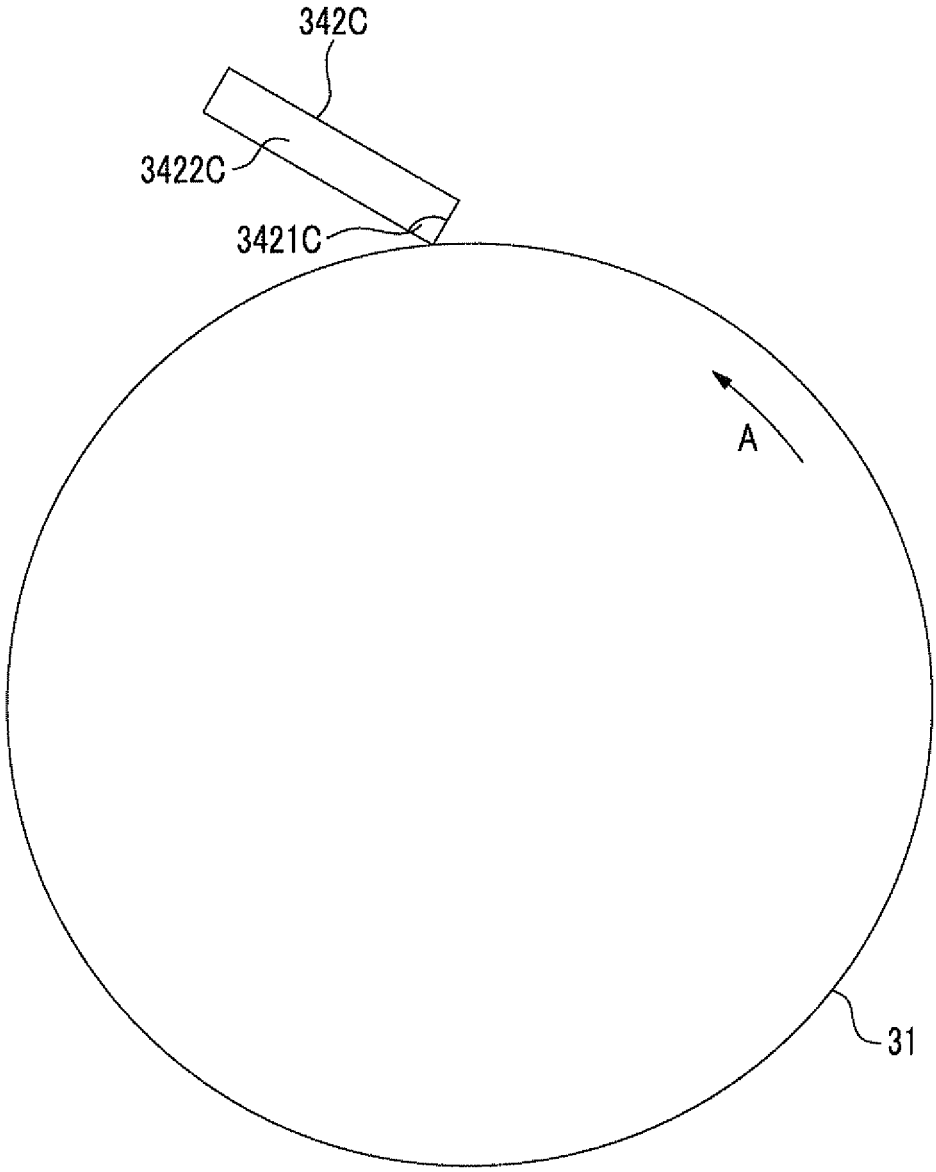
FIG. 6 is a view schematically showing another example of the cleaning blade according to the exemplary embodiment.

In a similar way to the third exemplary embodiment shown in FIG. 6, the cleaning blade according to the exemplary embodiment may have a configuration in which a contact member (edge member) 3421C and a rear face member 3422C are provided. The contact member 3421C is formed of the contact member that includes the portion to be brought into contact with the photoreceptor drum 31, that is, the contact corner portion 3A, and has a shape in which a quarter-cut cylinder extends in the depth direction and a right angle portion of the shape forms the contact corner portion 3A. The rear face member 3422C covers the rear face 3D side in the thickness direction of the contact member 3421C and a side opposite to the tip end face 3B in the width direction, that is, forms a portion other than the contact member 3421C and is formed of a different material from that of the contact member.

In addition, as the contact member, a member having a quarter-cut cylinder shape is exemplified in FIG. 6 but the shape thereof is not limited thereto. Examples of the shape of the contact member may include a shape in which an elliptic cylinder is cut into quarters or a shape such as a square prism or a rectangular prism.

Hereinafter, a method for controlling the movement distance of the cleaning blade will be described.

Young's Modulus

For example, as the hardness of a portion (contact member) of the cleaning blade to be brought into contact with the image holding member is lowered, the movement distance tends to be increased.

A Young's modulus of the contact member of the cleaning blade is preferably from 12 MPa to 28 MPa. When the Young's modulus is more than the above-described lower limit, the movement distance of the cleaning blade is suppressed. As a result, the abrasion is suppressed. On the other hand, when the Young's modulus is less than the above-described upper limit, the contact member is excessively hardened and the cleaning blade appropriately follows the image holding member which is driven. As a result, it is possible to obtain a good cleaning performance.

The Young's modulus of the contact member is more preferably from 15 MPa to 21 MPa.

The Young's modulus of the contact member of the cleaning blade is measured by a tensile test. In the tensile test, generally, the Young's modulus is calculated by applying a tensile load to a rod-shaped or plate-shaped specimen and then calculating the displacement. When the contact member is larger than a specimen to be obtained, a specimen is prepared by cutting the specimen from the contact member. When the contact member is smaller than a specimen to be obtained, a rod-shaped or plate-shaped specimen is prepared using the same material as that of the contact member. The Young's modulus is calculated from the slope of the stress (load)-strain (displacement) curve using a stain gauge (manufactured by Kyowa Electronic Instruments Co., Ltd., DPM-602B) as a displacement measuring method.

A method for controlling the Young's modulus of the contact member is not particularly limited but the following method is exemplified.

For example, when a material of the contact member of the cleaning blade is polyurethane, the Young's modulus tends to be increased by improving the crystallinity of the polyurethane.

In addition, the Young's modulus tends to be increased by increasing an NCO index (NCO/OH ratio) or increasing an amount of a cross-linking agent.

Frictional Force

As the frictional force between the cleaning blade and the image holding member is increased, the movement distance tends to be increased. Moreover, the frictional force is a physical property calculated from the product of a coefficient of friction and a normal force.

In the exemplary embodiment, the coefficient of kinetic friction between the cleaning blade and the image holding member is preferably from 0.4 to 1.2. When the coefficient of kinetic friction between the cleaning blade and the image holding member is equal to or less than the above-described upper limit, the movement distance of the cleaning blade is suppressed. As a result, the abrasion is suppressed. On the other hand, when the coefficient of kinetic friction between the cleaning blade and the image holding member is equal to or more than the above-described lower limit, the cleaning blade appropriately follows the image holding member which is driven. As a result, it is possible to obtain a good cleaning performance.

In addition, the coefficient of kinetic friction between the cleaning blade and the image holding member is preferably from 0.6 to 0.8.

The coefficient of kinetic friction of the contact member itself of the cleaning blade is preferably from 0.4 to 1.1, more preferably from 0.45 to 1.05, and still more preferably from 0.49 to 0.9. When the coefficient of friction of the contact member itself is in the above-described range, it is possible to control the coefficient of kinetic friction when the cleaning blade is brought into contact with an image holding member generally used in the image forming apparatus to be in the above-described range.

The coefficient of kinetic friction between the cleaning blade and the image holding member is measured by the following method. An apparatus used in the measurement is configured to use a HEIDON Surface Property Tester (manufactured by Shinto Scientific Co., Ltd.) and, further, to modify an image holding member rotating mechanism and an image holding member attachment stage and to additionally use a TriboSoft as the control software. The measurement is carried out in such a manner that, in a state where a developer is supplied, a piece of the cleaning blade with a size of 10 mm×10 mm is pressed to be brought into contact with the image holding member and then the image holding member is rotated. A frictional force at the time of the rotation is measured and the coefficient of kinetic friction is calculated by dividing the frictional force by a normal force (=frictional force/normal force).

In addition, the coefficient of kinetic friction of the cleaning blade itself is measured by the following method. The above-described apparatus is used in the measurement. The measurement is carried out in such a manner that the image holding member to the surface of which a polyethylene film seal is attached is set to be a counterpart member, a piece of the cleaning blade with a size of 10 mm×10 mm is pressed to be brought into contact with the polyethylene film seal portion and then the image holding member is rotated. A frictional force at the time of the rotation is measured and the coefficient of kinetic friction is calculated by dividing the frictional force by a normal force (=frictional force/normal force).

The coefficient of kinetic friction is not particularly limited but, for example, the coefficient of kinetic friction is adjusted by a material of the portion of the cleaning blade to be brought into contact with the image holding member and a material of the surface of the image holding member.

In other words, the normal force is a pressing force of the cleaning blade to the image holding member in a vertical direction. The normal force is adjusted by a length of the cleaning blade biting into the image holding member, an angle W/A (Working Angle) at the contact portion of the cleaning blade and the image holding member, rebound resilience of the entire cleaning blade, a free length of the cleaning blade, a length of the cleaning blade in a thickness direction thereof, or the like.

In the cleaning blade according to the exemplary embodiment, the force NF (Normal Force) when the cleaning blade is pressed to be brought into contact with the image holding member is preferably in a range of from 1.35 gf/mm to 3.15 gf/mrn and more preferably from 1.5 gf/mm to 2.25 gf/mm.

In addition, the pressing force NF is calculated from the product of a spring constant (gf/mm$^2$) of the cleaning blade and an amount of the cleaning blade biting into the image holding member when the cleaning blade is pressed to be brought into contact with the image holding member.

A length of the tip end portion of the cleaning blade biting into the image holding member is preferably in a range of from 0.7 mm to 1.5 mm and more preferably in a range of from 1.0 mm to 1.4 mm.

An angle W/A (Working Angle) at the contact portion of the cleaning blade and the image holding member is preferably in a range of from 6° to 15°, and more preferably in a range of from 8.5° to 12.5°.

Figure 7:
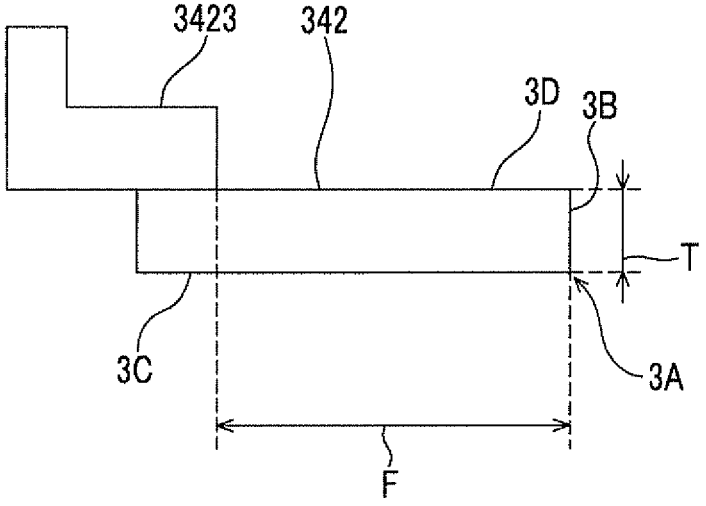
FIG. 7 is a view schematically showing a state where the cleaning blade according to the exemplary embodiment is supported by a supporting member.

As shown in FIG. 4 and FIG. 7, the cleaning blade 342 is supported by a supporting member (holder) 3423 attached to the rear face 3D. A length from the end of the tip end face 3B side of the rear face 3D of the cleaning blade 342 to the end of the tip end face 3B of the supporting member 3423 in a state where the supporting member 3423 is adhered to the rear face 3D, that is, a length of the region in the width direction of the rear face 3D not supported by supporting member 3423 (so-called blade free length (F)) is preferably in a range of from 6.0 mm to 8.0 mm and more preferably in a range of from 7 mm to 7.5 mm.

Moreover, typically, the entire adhesive face of the supporting member 3423 and rear face 3D is coated with an adhesive so as to be attached to each other. However, the supporting member 3423 and the rear face 3D may be attached to each other in a state where the adhesive is applied to the tip end face 3B side farther than the end of the tip end face 3B side of the supporting member 3423. On the other hand, the supporting member 3423 and the rear face 3D may be attached to each other in a state where the adhesive is not applied up to the end of the tip end face 3B of the supporting member 3423, that is, there is a region which is not adhered to the end side of the supporting member 3423. However, even in any case as described above, the blade free length (F) is not the end of the region in which the adhesive is applied but the end of the tip end face 3B side of the supporting member 3423 as a standard.

A thickness (length (T) in the thickness direction shown in FIG. 7) of the cleaning blade (not including the supporting member) is preferably in a range of from 1.5 mm to 2.0 mm and more preferably in a range of from 1.9 mm to 2.0 mm.

When the cleaning blade is configured to include the contact member and the non-contact member, the rebound resilience of the entire cleaning blade is adjusted and, from the viewpoint of adjusting the movement distance to be in the above-described range, it is preferable that the JIS A hardness of the non-contact member be lower than the JIS A hardness of the contact member.

Subsequently, the composition of the contact member, which forms a portion of the cleaning blade according to the exemplary embodiment to be brought into contact with the image holding member at least, will be described.

Contact Member

The contact member of the cleaning blade according to the exemplary embodiment is not particularly limited. Examples thereof include polyurethane rubber, silicon rubber, fluorine rubber, chloroprene rubber and butadiene rubber. In addition, from the viewpoint of satisfying the above-described requisites of the movement distance, polyurethane rubber is preferable and, particularly, high crystalline polyurethane rubber is more preferable.

As a method for improving the crystallinity of polyurethane, a method in which a hard segment aggregate in polyurethane is subjected to further growth is exemplified. Specifically, by adjusting a circumstance such that a physical cross-linking (cross-linking by hydrogen bonding between hard segments) more effectively proceeds than a chemical cross-linking (cross-linking by a cross-linking agent) when a cross-linked structure in polyurethane is formed, it is possible to achieve the circumstance in which the growth of the hard segment aggregate is more easily performed. Moreover, as a polymerization temperature is set to be lower when polymerizing polyurethane, an aging time becomes longer. As a result, the physical cross-linking tends to further proceed.

Endothermic Peak Top Temperature

As a crystallinity index, an endothermic peak top temperature (melting temperature) is exemplified. In the cleaning blade according to the exemplary embodiment, the endothermic peak top temperature (melting temperature) measured by using a differential scanning calorimetry (DSC) is preferably 180° C. or higher, more preferably 185° C. or higher, and still more preferably 190° C. or higher. In addition, the upper limit thereof is preferably 220° C. or lower, more preferably 215° C. or lower, and still more preferably 210° C. or lower.

The endothermic peak top temperature (melting temperature) is measured by using a differential scanning calorimetry (DSC) according to ASTMD3418-99. The measurement thereof is carried out by using Diamond-DSC (manufactured by Perkin Elmer, Inc.). The temperature correction at a detection unit of the apparatus is carried out by using the melting point of indium and zinc, the correction of heat quantity is carried out by using the heat of fusion of indium. The measurement is carried out by using a pan made of aluminum for a measurement sample, and by setting a vacant pan for control.

Particle Size and Particle Size Distribution of Hard Segment Aggregate

In the exemplary embodiment, polyurethane rubber contains a hard segment and a soft segment. The average particle size of the hard segment aggregate is preferably from 5 μm to 20 μm.

When the average particle size of the hard segment aggregates is 5 μm or larger, the crystallization area on the blade surface is increased and thus there is an advantage of improving the slidability. On the other hand, when the average particle size of the hard segment aggregates is 20 μm or less, there is an advantage that the toughness (chipping resistance) is not lost while maintaining low frictional properties.

The average particle size thereof is more preferably from 5 μm to 15 μm and still more preferably from 5 μm to 10 μm.

The particle size distribution (standard deviation σ) of the hard segment aggregates is preferably 2 or more.

The fact that the particle size distribution (standard deviation σ) of the hard segment aggregates is 2 or more means that the aggregates having various particle sizes are mixed. Since the contact region of the hard segments and soft segments is increased by aggregates having a small particle size, it is possible to achieve a high hardness effect. On the other hand, by aggregates having a large particle size, it is possible to obtain an effect of improving the slidability.

The particle size distribution thereof is more preferably from 2 to 5 and still more preferably from 2 to 3.

The average particle size and the particle size distribution of the hard segment aggregates are measured by the following method. Images are captured at ×20 magnification using a polarizing microscope (Bx51-P manufactured by OLYMPUS CORPORATION) and the images are binarized by performing an image processing. The particle sizes of five images per one cleaning blade are measured (five aggregates per one image are measured) and then the measurement is carried out on 20 cleaning blades. An average particle size is calculated from a total of 500 aggregates.

Further, the binarization of images is carried out using the image analysis software "OLYMPUS Stream essentials" (provided by OLYMPUS CORPORATION) and hue, saturation and luminescence thresholds are adjusted such that a crystalline part becomes black and a non-crystalline part becomes white.

A particle size distribution (standard deviation σ) is calculated from the measured particle size of 500 particles using the following formula.

$$\text{Standard deviation } \sigma=\sqrt{\{(X1-M)^2+(X2+M)_2+\ldots+(X500-M)^2\}/500}$$

Xn: particle sizes n to be measured (n=1 to 500)

M: average value of particle sizes to be measured

A method in which the particle size and the particle size distribution of the hard segment aggregate are controlled to be in the above-described range is not particularly limited but, for example, methods such as a reaction control method using a catalyst, a three dimensional network control method using a cross-linking agent, and a crystal growth control method using aging conditions may be exemplified.

Generally, polyurethane rubber is synthesized by polymerizing polyisocyanate and polyol. In addition, instead of polyol, a resin having a functional group reactive to an isocyanate group may be used. Further, it is preferable that the polyurethane rubber contain hard segments and soft segments.

Herein, "hard segments" and "soft segments" mean that the material composing the former is a material relatively harder than the material composing the latter and the material composing the latter is a material relatively softer than the material composing the former, among polyurethane rubber materials.

A combination of the material composing hard segments (hard segment material) and the material composing soft segments (soft segment material) is not particularly limited and may be selected from well-known resin materials such that one of the materials is relatively harder than the other of materials and the other of materials is relatively softer than one of the materials. However, in the exemplary embodiment, the following combination is preferably used.

Soft Segment Material

First, examples of polyols used for the soft segment material include polyester polyol obtained by dehydration condensation of diol and diacid; polycarbonate polyol obtained by a reaction between diol and alkyl carbonate; polycaprolactone polyol and polyether polyol. In addition, examples of commercial products of the polyol used as the soft segment material include Placcel 205 or Placcel 240 manufactured by Daicel Chemical Industries, Ltd.

Hard Segment Material

As the hard segment material, a resin having a functional group reactive to an isocyanate group is preferably used. In addition, a resin having flexibility is preferable, and an aliphatic resin having a straight chain structure is more preferable in terms of the flexibility. As specific examples thereof, acrylic resins having two or more hydroxyl groups; polybutadiene resins having two or more hydroxyl groups; epoxy resins having two or more epoxy groups are preferably used.

Examples of commercial products of the acrylic resin having two or more hydroxyl groups include ACTFLOW (grade: UMB-2005B, UMB-2005P, UMB-2005, UME-2005 and the like) manufactured by Soken Chemical Engineering Co., Ltd.

Examples of commercial products of the polybutadiene resin having two or more hydroxyl groups include R-45HT manufactured by Idemitsu Kosan Co., Ltd. and the like.

An example of the epoxy resin having two or more epoxy groups is not an epoxy resin having hard and fragile properties of the related art, but is preferably a more flexible and tougher epoxy resin than the epoxy resins of the related art.

Such an epoxy resin may have, in the main chain structure, a structure (a flexible skeleton) that improves the flexibility of the main chain in terms of molecular structure. The flexible structure may be an alkylene skeleton, a cycloalkane skeleton, or a polyoxyalkylene skeleton, and preferably a polyoxyalkylene skeleton.

In addition, in terms of physical properties, epoxy resins with a low viscosity for its molecular weight as compared with epoxy resins of the related art are preferable. Specifically, a weight average molecular weight thereof is in a range of 900±100 and a viscosity thereof at 25° C. is preferably in a range of 15,000±5,000 mPa·s, and more preferably in a range of 15,000±3,000 mPa·s. Examples of commercial products of the epoxy resin having such properties include EPLICON EXA-4850-150 manufactured by DIC Corporation and the like.

When the hard segment material and the soft segment material are used, the weight ratio of the material configuring the hard segment (hereinafter, referred to as a "hard segment material ratio") is preferably in a range of from 10% by weight to 30% by weight, more preferably in a range of from 13% by weight to 23% by weight, and still more preferably in a range of from 15% by weight to 20% by weight, with respect to the total weight of the hard segment material and the soft segment material.

By setting the hard segment material ratio to be 10% or more by weight, it is possible to obtain abrasion resistance and thus a good cleaning performance is maintained for a long time. On the other hand, by setting the hard segment material ratio to be 30% or less by weight, it is possible to obtain flexibility and expansibility without being excessively hardened and to suppress the occurrence of cracking. Therefore, a good cleaning performance is maintained for a long time.

Polyisocyanate

Examples of polyisocyanate used in synthesis of polyurethane rubber include 4,4'-diphenylmethane di isocyanate (MDT), 2,6-toluene diisocyanate (TDI), 1,6-hexane diisocyanate (HDI), 1,5-naphthalene diisocyanate (NDI) and 3,3-dimethylphenyl-4,4-diisocyanate (TODI).

In addition, from the viewpoint of easily forming a hard segment aggregate having a desired size (particle size), as the polyisocyanate, 4,4'-diphenylmethane diisocyanate (MDI), 1,5-naphthalene diisocyanate (NDI) and 1,6-hexane diisocyanate (HDI) are more preferable.

The mixing amount of the polyisocyanate is preferably from 20 parts by weight to 40 parts weight, more preferably from 20 parts by weight to 35 parts by weight, and still more preferably from 20 parts by weight to 30 parts by weight, with respect to 100 parts by weight of the resin having a functional group reactive to an isocyanate group.

By setting the mixing amount thereof to be 20 or more parts by weight, it is possible to secure a large urethane bonding amount so as to attain the hard segment growth and to obtain the desired hardness. On the other hand, by setting the mixing amount thereof to be 40 or less parts by weight, it is possible to obtain expansibility without the hard segment becoming excessively large and to suppress the occurrence of cracking in the cleaning blade.

Cross-Linking Agent

Examples of the cross-linking agent include diol (bifunctional), triol (trifunctional) and tetraol (tetrafunctional) and these examples may be used as a combination thereof. In addition, an amine type compound may be used as a cross-linking agent. Moreover, it is preferable to perform cross-linking using a trifunctional or higher-functional cross-linking agent. Examples of the trifunctional cross-linking agent include trimethylolpropane, glycerin, and triisopropanolamine.

A mixing amount of the cross-linking agent to 100 parts by weight of the resin having a functional group reactive to an isocyanate group is preferably 2 parts by weight or less. When the mixing amount thereof is 2 parts by weight or less, molecular movement is not restricted by the chemical cross-linking and a hard segment derived from urethane bond by aging is largely grown, thereby easily obtain a desired hardness.

Method for Preparing Polyurethane Rubber

For preparing a polyurethane rubber member composing the contact member according to the exemplary embodiment, general methods for preparing polyurethane such as a prepolymer method and a one-shot method are used. In the exemplary embodiment, the prepolymer method is preferable from the viewpoint of obtaining polyurethane having superior strength and abrasion resistance but the exemplary embodiment is not limited by preparation methods.

As a method for controlling the endothermic peak top temperature (melting temperature) of the contact member to be in the above-described range, a method for controlling the endothermic peak top temperature thereof to be in an appropriate range while improving crystallinity of the polyurethane member is exemplified. For example, a method in which a hard segment aggregate in polyurethane is subjected to further growth is exemplified. Specifically, a method for adjusting such that a physical cross-linking (cross-linking by hydrogen bonding between hard segments) more effectively proceeds than a chemical cross-linking (cross-linking by a cross-linking agent) when a cross-linked structure in polyurethane is formed, is exemplified. As a polymerization temperature is set to be lower when polymerizing polyurethane, an aging time becomes longer. As a result, the physical cross-linking tends to further proceed.

By mixing an isocyanate compound, a cross-linking agent and the like with the above-described polyol, the polyurethane rubber member is formed under the molding condition in which irregularity of molecular arrangement may be suppressed.

Specifically, when preparing a polyurethane composition, cross-linking is adjusted to proceed slowly by lowering the temperature of polyol or prepolymer or lowering the temperature of curing and molding. By setting these temperatures (temperature of polyol or prepolymer and temperature of curing and molding) to be low and thus decreasing reactivity, urethane bonding portions are aggregated and thus it is possible to obtain hard segment crystals. Therefore, a temperature is adjusted such that the particle size of the hard segment aggregate becomes a desired crystal size.

According to this, molecules contained in the polyurethane composition are in a collateral state. Thus, the polyurethane rubber member including crystals in which the endothermic peak top temperature of crystal melting energy is in the above-described range when measuring DSC, is formed.

Moreover, the amounts of polyol, polyisocyanate and the cross-linking agent, the ratio of the cross-linking agent, and the like are adjusted to be in a desired range.

The cleaning blade is formed in such a manner that the composition for forming a cleaning blade prepared by the above-described method is formed in a sheet shape using centrifugal molding, extrusion molding or the like and a cut process or the like is carried out.

Herein, a method for preparing a contact member will be described in detail based on an example thereof.

At first, a soft segment material (for example, polycaprolactone polyol) and a hard segment material (for example, an acrylic resin containing two or more hydroxyl groups) are mixed (for example, weight ratio of 8:2).

Next, an isocyanate compound (for example, 4,4'-diphenylmethane diisocyanate) is added to the mixture of the soft segment material and the hard segment material and then reaction is carried out, for example, under a nitrogen atmosphere. The temperature at this time is preferably from 60° C. to 150° C. and more preferably from 80° C. to 130° C. In addition, the reaction time is preferably from 0.1 hour to 3 hours and more preferably from 1 hour to 2 hours.

Subsequently, an isocyanate compound is further added and reaction is carried out, for example, under a nitrogen atmosphere to obtain a prepolymer. The temperature at this time is preferably from 40° C. to 100° C. and more preferably 60° C. to 90° C. In addition, the reaction time is preferably from 30 minutes to 6 hours and more preferably from 1 hour to 4 hours.

Next, the temperature of the prepolymer is raised and the prepolymer is defoamed in reduced pressure. The temperature at this time is preferably from 60° C. to 120° C. and more preferably from 80° C. to 100° C. In addition, the reaction time is preferably from 10 minutes to 2 hours and more preferably from 30 minutes to 1 hour.

Thereafter, a cross-linking agent (for example, 1,4-butanediol or trimethylolpropane) is added to the prepolymer, followed by mixing. Thus, a composition for forming a cleaning blade is prepared.

Next, the composition for forming a cleaning blade is injected into a die of a centrifugal molding apparatus and then curing reaction is carried out. The die temperature at this time is preferably from 80° C. to 160° C. and more preferably from 100° C. to 140° C. In addition, the reaction time is preferably from 20 minutes to 3 hours and more preferably from 30 minutes to 2 hours.

Further, cross-linking reaction and cooling are carried out and then cutting is performed to form a cleaning blade. The temperature of aging and heating at the time of the cross-linking reaction is preferably from 70° C. to 130° C., more preferably from 80° C. to 130° C. and still more preferably from 100° C. to 120° C. In addition, the reaction time is preferably from 1 hour to 48 hours and more preferably from 10 hours to 24 hours.

Physical Property

In the specific member, a ratio of the physical cross-linking (cross-linking by hydrogen bonding between hard segments) to "1" of the chemical cross-linking (cross-linking by a cross-linking agent) in the polyurethane rubber is preferably 1:0.8 to 1:2.0 and more preferably 1:1 to 1:1.8.

When the ratio of the physical cross-linking to the chemical cross-linking is equal to or more than the above-described lower limit, the hard segment aggregate is further grown and it is possible to obtain an effect of low friction derived from crystals. On the other hand, when the ratio thereof is equal to or less than the above-described upper limit, it is possible to obtain an effect of maintaining toughness.

Proportions of the chemical cross-linking and the physical cross-linking are calculated using the following Mooney-Rivlin equation.

$$\sigma=2C_1(\lambda-1/\lambda^2)+2C_2(1-1/\lambda^3)$$

$\sigma$: stress, $\lambda$: strain, $C_1$: chemical cross-linking density, $C_2$: physical cross-linking Moreover, $\sigma$ and $\lambda$ at 10% elongation from the stress-strain curve by the tensile test are used.

In the specific member, a ratio of the hard segment to "1" of the soft segment in the polyurethane rubber is preferably 1:0.15 to 1:0.3 and more preferably 1:0.2 to 1:0.25.

When the ratio of the hard segment to the soft segment is equal to or more than the above-described lower limit, the amount of the hard segment aggregates is increased and thus it is possible to obtain an effect of low friction. On the other hand, when the ratio thereof is equal to or less than the above-described upper limit, it is possible to obtain an effect of maintaining toughness.

The ratio of the soft segment and the hard segment is obtained by calculating a composition ratio from a spectral area ratio of isocyanate as a hard segment component, a chain extender, and polyol as a soft segment component by using $^1$H-NMR.

A weight average molecular weight of the polyurethane rubber member according to the exemplary embodiment is preferably in a range of from 1,000 to 4,000 and more preferably in a range of from 1,500 to 3,500.

Next, the description will be given of the composition of the non-contact member in a case where the contact member and a region (non-contact member) other than the contact portion of the cleaning blade according to the exemplary embodiment are respectively formed of different materials in a similar way to the second exemplary embodiment shown in FIG. 5 and the third exemplary embodiment shown in FIG. 6.

Non-Contact Member

The non-contact member of the cleaning blade according to the exemplary embodiment is not particularly limited and any well-known materials may be used.

Rebound Resilience

It is preferable that the non-contact member be formed of a material in which rebound resilience at 25° C. is from 35% to 55%.

The rebound resilience (%) at 25° C. is measured under environment with a temperature of 25° C. according to JIS K 6255 (1996). Further, when the dimension of the non-contact member of the cleaning blade is larger than that of the specimen according to JIS K 6255, the measurement is carried out by cutting a piece having the dimension of the specimen from the non-contact member. On the other hand, when the dimension of the non-contact member is smaller than that of the specimen, the specimen is formed of the same material as the non-contact member and then the measurement is carried out on the above-described specimen.

A method for controlling the rebound resilience at 25° C. of the non-contact member is not particularly limited. However, for example, when the non-contact member is polyurethane, by adjusting a glass transition temperature (Tg) by lowering the molecular weight of polyol or hydrophobizing polyol, the rebound resilience thereof tends to be increased.

Permanent Elongation

The non-contact member of the cleaning blade according to the exemplary embodiment includes a material having a 100% permanent elongation of preferably 1.0% or less, more preferably 0.5% or less, and still more preferably 0.4% or less. In addition, the lower limit thereof is preferably 0.1% or more and more preferably 0.2% or more.

Hereinafter, a method for measuring the 100% permanent elongation (%) will be described.

According to JIS K 6262 (1997), a strip-shaped specimen is prepared, 100% tensile strain is applied thereto and then the strip-shaped specimen is allowed to stand for 24 hours. Thereafter, the permanent elongation is calculated from a distance between marked lines as shown in the following formula.

$$Ts=(L2-L0)/(L1-L0)\times 100$$

Ts: permanent elongation

L0: distance between marked lines before applying tension

L1: distance between marked lines at the time of applying tension

L2: distance between marked lines after applying tension

Further, when the dimension of the non-contact member of the cleaning blade is larger than that of the strip-shaped specimen according to JIS K 6262, the measurement is carried out by cutting a piece having the dimension of the strip-shaped specimen from the non-contact member. On the other hand, when the dimension of the non-contact member is smaller than that of the strip-shaped specimen, the strip-shaped specimen is formed of the same material as the non-contact member and then the measurement is carried out on the above-described strip-shaped specimen.

A method for controlling a 100% permanent elongation of the non-contact member is not particularly limited. However, for example, the permanent elongation thereof tends to change by adjusting an amount of the cross-linking agent or a molecular weight of polyol when the non-contact member is polyurethane.

Examples of materials used in the non-contact member include polyurethane rubber, silicon rubber, fluorine rubber, chloroprene rubber, and butadiene rubber. Among these, polyurethane rubber is preferable. Examples of the polyurethane rubber include ester type polyurethane rubber and ether type polyurethane rubber and, particularly, ester type polyurethane rubber is preferable.

At the time of producing the polyurethane rubber, a method using polyol and polyisocyanate is used.

Examples of the polyol include polytetramethyl ether glycol, polyethylene adipate and polycaprolactone.

Examples of the polyisocyanate includes 2,6-toluene diisocyanate (TDI), 4,4'-diphenylmethane diisocyanate (MDI), p-phenylene diisocyanate (PPDI), 1,5-naphthalene diisocyanate (NDI), and 3,3-dimethyldiphenyl-4,4'-diisocyanate (TODI). Among these, MDI is preferable.

In addition, examples of a curing agent for curing polyurethane include 1,4-butanediol, trimethylolpropane, ethylene glycol and a mixture thereof.

For description based on a specific example, for example, it is preferable to use the composition obtained by using the prepolymer, produced by mixing diphenyl methane-4,4-diidocyanate to polytetramethyl ether glycol subjected to the dehydration treatment and causing the reaction, in combination with 1,4-butanediol and trimethylolpropane as a curing agent. Further, an additive such as a reaction conditioning agent may be added.

A well-known method of the related art is used for the method of preparing the non-contact member, depending on raw materials used in the preparation thereof and, for example, the non-contact member is prepared by molding such as centrifugal molding and extrusion molding, cutting into a predetermined shape, or the like.

Preparation of Cleaning Blade

When the cleaning blade has a multi-layer structure such as a two-layer structure shown in FIG. 5, the cleaning blade is prepared by bonding a first layer as a contact member and a second layer as a non-contact member (plural layers when the cleaning blade has a three- or more layer structure) to each other. As the bonding method, methods using a double-sided adhesive tape, various adhesives or the like are desirably used. In addition, plural layers may adhere to each other in such a manner that a material of each layer is injected into a die at different times during molding so as to combine materials without providing an adhesive layer.

In a case of the configuration having the contact member (edge member) and the non-contact member (rear face member) shown in FIG. 6, a first die having a cavity (a region into which a composition for forming a contact member is injected) corresponding to a semicircular column shape, in which the belly faces 3C of two contact members 3421C shown in FIG. 6 are overlapped, and a second die having a cavity corresponding to a shape, in which the belly faces 3C of two of the contact member 3421C and the non-contact member 3422C are overlapped, are prepared. The composition for forming a contact member is injected into the cavity of the first die and is subjected to curing. Thus, a first molded product having a shape, in which two of the contact members 3421C are overlapped, is formed. Subsequently, after detaching the first die, the second die is installed such that the first molded product is disposed inside the cavity of the second die. Thereafter, the composition for forming a non-contact member is injected into the cavity of the second die so as to cover the first molded product and then is subjected to curing. Thus, a second molded product having a shape in which two belly faces 3C of the contact member 3421C and the non-contact member 3422C are overlapped to each other is formed. Next, the formed second molded product is cut at the central portion thereof, that is, a portion to be the belly face 3C and the semicircular column-shaped contact member is cut at the central portion thereof so as to be a quarter-cut cylinder shape. Further, cutting into a predetermined dimension is carried out and thus a cleaning blade shown in FIG. 6 is obtained.

Image Holding Member

Next, the image holding member (photoreceptor drum) 31 disposed in the tandem type image forming apparatus shown in FIG. 3 will be described in detail.

As the image holding member according to the exemplary embodiment, for example, the image holding member includes a substrate, a photosensitive layer, and a surface layer.

Herein, the photosensitive layer according to the exemplary embodiment may be an integrated function type photosensitive layer having a charge transporting function and a charge generating function or may be a function separation type photosensitive layer including a charge transporting layer and a charge generating layer. In addition, other layers such as an undercoat layer may be provided or the surface layer may not be provided.

Hereinafter, the configuration of the image holding member according to the exemplary embodiment will be described with reference to FIGS. 8 and 9 but the exemplary embodiment is not limited to FIGS. 8 and 9.

Figure 8:
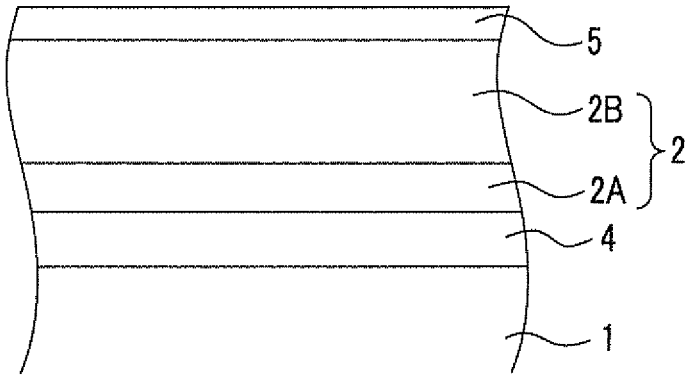
FIG. 8 is a partially cross-sectional view schematically showing an image holding member according to a first embodiment.

FIG. 8 is a cross-sectional view schematically showing an example of a layer configuration of the image holding member according to the exemplary embodiment. In FIG. 8, 1 indicates a substrate; 2 indicates a photosensitive layer; 2A indicates a charge generating layer; 2B indicates a charge transporting layer; 4 indicates undercoat layer; and 5 indicates a surface layer.

The image holding member shown in FIG. 8 has a layer configuration in which the undercoat layer 4, the charge generating layer 2A, the charge transporting layer 2B, and the surface layer 5 are laminated on the substrate 1 in this order. The photosensitive layer 2 is configured to include two layers of the charge generating layer 2A and the charge transporting layer 2B (first embodiment).

Figure 9:
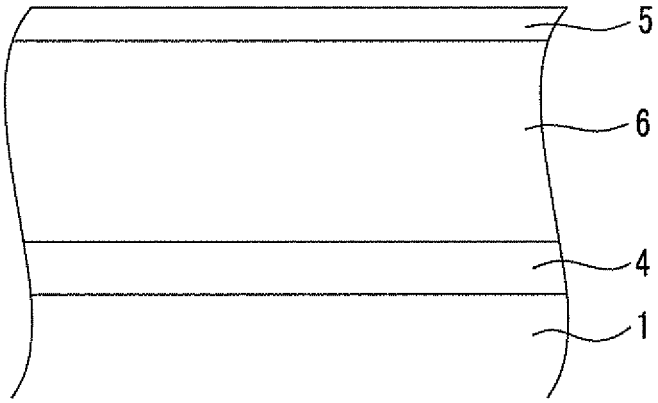
FIG. 9 is a partially cross-sectional view schematically showing an image holding member according to a second embodiment.

FIG. 9 is a cross-sectional view schematically showing another example of a layer configuration of the image holding member according to the exemplary embodiment. In FIG. 9, 6 indicates an integrated function type photosensitive layer and other components are the same as shown in FIG. 8.

The image holding member shown in FIG. 9 has a layer configuration in which the undercoat layer 4, the photosensitive layer 6, and the surface layer 5 are laminated on the substrate 1 in this order. The photosensitive layer 6 is a layer in which functions of the charge generating layer 2A and the charge transporting layer 2B shown in FIG. 8 are integrated (second embodiment).

Hereinafter, the respective layers of the image holding member according to the exemplary embodiment will be described based on the image holding member shown in FIG. 8 as a representative example.

First Embodiment

As shown in FIG. 8, the image holding member according to the first embodiment has a layer configuration in which the undercoat layer 4, the charge generating layer 2A, the charge transporting layer 2B, and the surface layer 5 are laminated on the substrate 1 in this order.

Substrate

As the substrate 1, a substrate having conductivity is used and examples thereof include metal plates, metal drums and metal belts in which metals, such as aluminum, copper, zinc, stainless steel, chromium, nickel, molybdenum, vanadium, indium, gold and platinum or an alloy thereof, are used; or paper, plastic films and belts which are coated, vapor-deposited or laminated with a conductive compound such as a conductive polymer or indium oxide, metals such as aluminum, palladium and gold or an alloy thereof. Herein, the term "conductivity" means that the volume resistivity is less than $10^{13}$ Ωcm.

When the image holding member according to the first embodiment is used in a laser printer, it is preferable that the surface of the substrate 1 be roughened so as to have a centerline average roughness Ra of from 0.04 μm to 0.5 μm. However, when an incoherent light source is used as a light source, surface roughening may not be necessary.

As the method for surface roughening, a wet honing in which an abrasive suspended in water is blown onto a support, centerless grinding in which a support is continuously ground by bringing the support into contact with a rotating grind stone, anodic oxidation, and the like are preferable.

As another method of surface roughening, a method of surface roughening by forming a layer in which conductive or semiconductive particles are dispersed in resin on the surface of the support so that the surface roughening is achieved by the particles dispersed in the layer, without roughing the surface of the substrate 1, may also be used preferably.

Herein, in the surface roughening treatment by anodic oxidation, an oxide film is formed on an aluminum surface by anodic oxidation in which aluminum as anode is anodized in an electrolyte solution. Examples of the electrolyte solution include a sulfuric acid solution and an oxalic acid solution. However, the porous anodic oxide film formed by anodic oxidation without modification is chemically active. Therefore, it is preferable to perform a sealing treatment in which fine pores of the anodic oxide film are sealed by volume expansion caused by hydration in pressurized water vapor or boiled water (to which a metal salt such as a nickel salt may be added) to transform the anodic oxide into a more stable hydrated oxide. The thickness of the anodic oxide film is preferably from 0.3 μm to 15 μm.

The substrate 1 may be subjected to a treatment with an acidic aqueous solution or a boehmite treatment.

The treatment with an acidic treatment solution including phosphoric acid, chromic acid and hydrofluoric acid is carried out as follows. First, the acidic treatment solution is prepared. A mixing ratio of phosphoric acid, chromic acid, and hydrofluoric acid in the acidic treatment solution is preferably in a range of from 10% by weight to 11% by weight of phosphoric acid, from 3% by weight to 5% by weight of chromic acid, and from 0.5% by weight to 2% by weight of hydrofluoric acid. The concentration of the total acid components is preferably in a range of from 13.5% by weight to 18% by weight. The treatment temperature is preferably from 42° C. to 48° C. The thickness of the film to be coated is preferably from 0.3 μm to 15 μm.

The boehmite treatment is carried out by dipping the substrate in pure water at a temperature of from 90° C. to 100° C. for from 5 minutes to 60 minutes, or by bringing the substrate into contact with heated water vapor at a temperature of from 90° C. to 120° C. for from 5 minutes to 60 minutes. The thickness of the film to be coated is preferably from 0.1 μm to 5 μm. The film may further be subjected to anodic oxidation using an electrolyte solution, which has a lower film dissolubility compared to other solutions, such as adipic acid, boric acid, boric acid salt, phosphoric acid salt, phthalic acid salt, maleic acid salt, benzoic acid salt, tartaric acid salt and citric salt solutions.

Undercoat Layer

The undercoat layer 4 is configured to include, for example, binder resin containing inorganic particles.

The inorganic particles preferably have powder resistance (volume resistivity) of from $10^2$ Ω·cm to $10^{11}$ Ω·cm.

As the inorganic particles having the above-described resistance value, inorganic particles (conductive metal oxide) such as tin oxide, titanium oxide, zinc oxide, and zirconium oxide are preferably used and zinc oxide is particularly preferably used.

The inorganic particles may be the ones which have been subjected to a surface treatment. Particles which have been subjected to different surface treatments, or those having different particle sizes, may be used in combination of two or more kinds. The volume average particle size of the inorganic particles is preferably in a range of from 50 nm to 2,000 nm (more preferably from 60 nm to 1,000 nm).

Inorganic particles having a specific surface area measured by BET method of 10 $m^2/g$ or more are preferably used.

The undercoat layer 4 may contain an acceptor compound in addition to inorganic particles. Any acceptor compound may be used and examples thereof include electron transporting substances such as quinone type compounds such as chloranil and bromanil; tetracyanoquinodimethane type compounds; fluorenone compounds such as 2,4,7-trinitrofluorenone and 2,4,5,7-tetranitro-9-fluorenone; oxadiazole type compounds such as 2-(4-biphenyl)-5-(4-t-butylphenyl)-1,3,4-oxadiazole, 2,5-bis(4-naphtyl)-1,3,4-oxadiazole and 2,5-bis(4-diethylaminophenyl)-1,3,4-oxadiazole; xanthone type compounds; thiophene compounds and diphenoquinone compounds such as 3,3',5,5'-tetra-t-butyldiphenoquinone, and compounds having an anthraquinone structure are particularly preferable. Acceptor compounds having an anthraquinone structure such as hydroxyanthraquinone type compounds, amino anthraquinone type compounds, and aminohydroxyanthraquinone type compounds are preferably used and specific examples thereof include anthraquinone, alizarin, quinizarin, anthrarufin and purpurin.

The content of the acceptor compound may be arbitrarily determined but the content thereof is preferably from 0.01% by weight to 20% by weight and more preferably from 0.05% by weight to 10% by weight with respect to the inorganic particles.

The acceptor compound may simply be added at the time of application of the undercoat layer 4, or may be previously attached to the surface of the inorganic particles. There are a dry method and a wet method as the method of attaching the acceptor compound to the surface of the inorganic particles.

When a surface treatment is carried out according to a dry method, the acceptor compound is added dropwise to the inorganic particles or sprayed thereto together with dry air or nitrogen gas, either directly or in the form of a solution in which the acceptor compound is dissolved in an organic solvent, while the inorganic particles are stirred with a mixer or the like having a high shearing force, whereby the particles may be treated. The addition or spraying is preferably carried out at a temperature equal to or less than the boiling point of the solvent. After the addition or spraying of the acceptor compound, the inorganic particles may further be subjected to baking at a temperature of 100° C. or more. The baking may be carried out at an arbitrary temperature for an arbitrary period of time.

In a wet method, the inorganic particles are stirred and dispersed in a solvent by ultrasonic waves, a sand mill, an attritor, a ball mill or the like, then the acceptor compound is added and the mixture is further stirred or dispersed, thereafter the solvent is removed, and whereby the particles may be treated. The solvent may be removed by filtration or distillation. After removing the solvent, the particles may be subjected to baking at a temperature of 100° C. or more. The baking may be carried out at arbitrary temperature for an arbitrary period of time. In the wet method, the moisture contained in the inorganic particles may be removed before adding the surface treatment agent. The moisture may be removed by, for example, stirring and heating the particles in the solvent used for the surface treatment, or by azeotropic removal with the solvent.

The inorganic particles may be subjected to a surface treatment before attaching the acceptor compound thereto. The surface treatment agent may be selected from known materials. Examples thereof include silane coupling agents, titanate-based coupling agents, aluminum-based coupling agents and surfactants. Particularly, silane coupling agents are preferably used. Silane coupling agents having an amino group are more preferably used.

Any silane coupling agents having an amino group may be used. Specific examples thereof include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-γ-aminopropyltriethoxysilane, but are not limited thereto.

The silane coupling agent may be used singly or in combination of two or more kinds thereof. Examples of the silane coupling agents which may be used in combination with the above-described silane coupling agents having an amino group include vinyltrimethoxysilane, γ-methacryloxypropyltris(β-methoxyethoxy) silane, β-(3,4-epoxycyclohexyl)ethyltrimethoxysilane, γ-glycidoxypropyl trimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N, N-bis(β-hydroxyethyl)-γ-aminopropyltriethoxysilane, and γ-chloropropyltrimethoxysilane, but are not limited thereto.

The surface treatment method may be any well-known method but a dry method or a wet method is preferably used. In addition, the attachment of the acceptor and the surface treatment using a coupling agent or the like may be carried out concurrently.

The content of the silane coupling agent with respect to the inorganic particles contained in the undercoat layer 4 may be arbitrarily determined, but the content thereof is preferably from 0.5% by weight to 10% by weight with respect to the inorganic particles.

As the binder resin contained in the undercoat layer 4, any well-known resin may be used. Examples thereof include known polymer resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transport resins having a charge transport group; and conductive resins such as polyaniline. Among these, resins which are insoluble in the coating solvent for the upper layer are preferably used. Particularly, phenolic resins, phenol-formaldehyde resins, melamine resins, urethane resins, epoxy resins and the like are preferably used. When two or more kinds of these resins are used in combination, the mixing ratio may be determined as necessary.

The ratio of the metal oxide, to which an acceptor property has been imparted, to the binder resin, or the ratio of the inorganic particles to the binder resin in the coating liquid for forming an undercoat layer may be arbitrarily determined.

Various additives may be used in the undercoat layer 4. Examples of the additives include known materials such as the polycyclic condensed type or azo-based type of the electron transport pigments, zirconium chelate compounds, titanium chelate compounds, aluminum chelate compounds, titanium alkoxide compounds, organic titanium compounds and silane coupling agents. A silane coupling agent is used for surface treatment of the metal oxide but may also be added to the coating liquid for forming an undercoat layer as additives. Specific examples of the silane coupling agent as an additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, ethylacetoacetate aluminum diisopropylate, and aluminum tris(ethyl acetoacetate), These compounds may be used alone, or as a mixture or a polycondensate of plural kinds thereof.

The solvent for preparing the coating liquid for forming an undercoat layer may be selected from well-known organic solvents such as alcohol-based, aromatic-based, hydrocarbon halide-based, ketone-based, ketone alcohol-based, ether-based, and ester-based solvents. Examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene.

These solvents used for dispersion may be used alone or as a mixture of two or more kinds thereof. When the solvents are mixed, any solvents, which may dissolve binder resin when they are mixed, may be used.

As methods of dispersing the inorganic particles, well-known methods such as those employing a roll mill, a ball mill, a vibration ball mill, an attritor, a sand mill, a colloid mill or a paint shaker may be used. In addition, as a coating method used in providing the undercoat layer 4, general methods such as a blade coating method, a wire bar coating method, a spray coating method, a dip coating method, a bead coating method, an air knife coating method and a curtain coating method may be used.

The undercoat layer 4 is formed on the substrate 1 using the thus obtained coating liquid for forming an undercoat layer.

In addition, the Vickers hardness of the undercoat layer 4 is preferably 35 or more.

Moreover, the thickness of the undercoat layer 4 may be appropriately determined but the thickness thereof is preferably 15 μm or more and more preferably from 15 μm to 50 μm The surface roughness of the undercoat layer 4 (ten point height of irregularities) is adjusted in the range of from ¼n (n is a refractive index of the upper layer) to ½2λ, wherein λ represents the wavelength of the laser for exposure to be used, in order to prevent a moire image. Particles of resin or the like may also be added to the undercoat layer for adjusting the surface roughness thereof. Examples of the resin particles include silicone resin particles and cross-linking polymethyl methacrylate resin particles.

The surface of the undercoat layer may be subjected to grinding for adjusting the surface roughness thereof. The grinding methods such as buffing, sandblast treatment, wet honing, and grinding treatment may be used.

The undercoat layer may be obtained by drying the applied coating liquid for forming an undercoat layer, which is usually carried out by evaporating the solvent at a temperature at which a film may be formed.

Charge Generating Layer

It is preferable that the charge generating layer 2A be a layer containing a charge generating material and binder resin at least.

Examples of the charge generating material include azo pigments such as bisazo and trisazo pigments; condensed-ring aromatic pigments such as dibromoantanthrone; perylene pigments; pyrrolopyrrole pigments; phthalocyanine pigments; zinc oxides; and trigonal selenium. Among these, for laser exposure in the near-infrared region, metal phthalocyanine pigments or metal-free phthalocyanine pigments are preferable. Particularly, hydroxygallium phthalocyanine disclosed in JP-A-05-263007, JP-A-05-279591 and the like, chlorogallium phthalocyanine disclosed in JP-A-05-98181, dichlorotin phthalocyanine disclosed in JP-A-05-140472, JP-A-05-140473 and the like and titanyl phthalocyanine disclosed in JP-A-04-189873, JP-A-05-43823 and the like are more preferable. In addition, for laser exposure in the near-ultraviolet region, condensed aromatic pigments such as dibromoantanthrone, thioindigo-based pigments, porphyrazine compounds, zinc oxides and trigonal selenium and the like are more preferable. When a light source having an exposure wavelength of from 380 nm to 500 nm is used, the charge generating material is preferably an inorganic pigment. When a light source having an exposure wavelength of from 700 nm to 800 nm is used, the charge generating material is preferably a metal or metal-free phthalocyanine pigment.

As the charge generating material, a hydroxygallium phthalocyanine pigment having the maximum peak wavelength in the range of from 810 nm to 839 nm in the spectral absorbance spectrum in the wavelength area of from 600 nm to 900 nm is preferably used. This hydroxygallium phthalocyanine pigment is different from V-type hydroxygallium phthalocyanine pigments of the related art and the maximum peak wavelength of the spectral absorbance spectrum thereof is shifted to the lower wavelength side than that of the V-type hydroxygallium phthalocyanine pigments of the related art.

It is preferable that the hydroxygallium phthalocyanine pigment having the maximum peak wavelength in the range of from 810 nm to 839 nm have an average particle size in a specific range and the BET specific surface area in a specific range. Specifically, the average particle size is preferably 0.20 μm or less and more preferably from 0.01 μm to 0.15 μm. Meanwhile, the BET specific surface area is preferably 45 $m^2/g$ or more, more preferably 50 $m^2/g$ or more, and particularly preferably from 55 $m^2/g$ to 120 $m^2/g$. The average particle size refers to a value represented by a volume average particle size (d50 average particle size), which is measured by a laser diffraction scattering particle size distribution measuring apparatus (LA-700, manufactured by HORIBA, Ltd.). The BET specific surface area refers to a value measured using a BET specific surface area measuring apparatus (manufactured by Shimadzu Corporation: FlowSorb II 2300) by a nitrogen substitution method.

The maximum particle size (maximum value of the primary particle size) of the hydroxygallium phthalocyanine pigment is preferably 1.2 μm or less, more preferably 1.0 μm or less, and still more preferably 0.3 μm or less.

It is preferable that the hydroxygallium phthalocyanine pigment have an average particle size of 0.2 μm or less, a maximum particle size of 1.2 μm or less, and a specific surface area value of 45 $m^2/g$ or more.

It is preferable that the hydroxygallium phthalocyanine pigment have diffraction peaks at Bragg angles (2θ±0.2°) of 7.5°, 9.9°, 12.5°, 16.3°, 18.6°, 25.1° and 28.3° in an X-ray diffraction spectrum using CuKα characteristic X-ray.

When the temperature is raised from 25° C. to 400° C., a thermal weight loss of the hydroxygallium phthalocyanine pigment is preferably from 2.0% to 4.0% and more preferably from 2.5% to 3.8%.

The binder resin used in the charge generating layer 2A may be selected from a wide range of insulating resins and may be selected from organic photoconductive polymers such as poly-N-vinyl carbazole, polyvinyl anthracene, polyvinyl pyrene and polysilane. Preferable examples of the binder resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binder resins may be used alone or in combination of two or more kinds thereof. The mixing ratio between the charge generating material and the binder resin is preferably in a range of from 10:1 to 1:10 by weight ratio. The term "insulating" means that the volume resistivity is $10^{13}$ Ωcm or more.

The charge generating layer 2A may be formed, for example, using coating liquid in which the above-described charge generating materials and binder resins are dispersed in a solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, and may be used alone or in combination of two or more kinds thereof.

As a method for dispersing the charge generating materials and the binder resins in the solvent, common methods such as a ball mill dispersion method, an attritor dispersion method and a sand mill dispersion method may be used. In addition, at the time of dispersing, it is efficient that the average particle size of the charge generating material is set to be 0.5 μm or less, preferably 0.3 μm or less and more preferably 0.15 μm or less.

For forming the charge generating layer 2A, common methods such as a blade coating method, a wire bar coating method, a spray coating method, a dip coating method, a bead coating method, an air knife coating method or a curtain coating method may be used.

The film thickness of the thus obtained charge generating layer 2A is preferably from 0.1 μm to 5.0 μm and more preferably from 0.2 μm to 2.0 μm.

Charge Transporting Layer

It is preferable that the charge transporting layer 2B be a layer containing a charge transporting material and binder resin at least or a layer containing a polymer charge transporting material.

Examples of the charge transporting material include electron transporting compounds, for example, quinone type compounds such as p-benzoquinone, chloranil, bromanil, and anthraquinone; tetracyanoquinodimethane type compounds; fluorenone compounds such as 2,4,7-trinitroflurenone; xanthone type compounds, benzophenone type compounds, cyanovinyl type compounds, and ethylene type compounds; and hole transporting compounds such as triarylamine type compounds, benzidine type compounds, arylalkane type compounds, aryl-substituted ethylene type compounds; stilbene type compounds, anthracene type compounds, and hydazone type compounds. These charge transporting materials may be used alone or in combination of two or more kinds thereof. However, the charge transporting materials are not limited to the above described examples.

From the viewpoint of charge mobility, preferable examples of the charge transporting material include a triarylamine derivative represented by the following structural formula (a-1) and a benzidine derivative represented by the following structural formula (a-2).

(a-1)

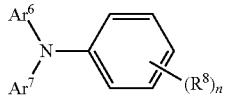

In the structural formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)═C(R^{10})(R^{11})$ or $—C_6H_4—CH═CH—CH═C(R^{12})(R^{13})$; $R^9$ to $R^{13}$ each independently represent a hydrogen atom, a substituted or unsubstituted alkyl group or a substituted or unsubstituted aryl group; the substituent is a halogen atom, an alkyl group having from 1 to 5 carbon atoms, an alkoxy group having from 1 to 5 carbon atoms, or a substituted amino group which is substituted with an alkyl group having from 1 to 3 carbon atoms.

(a-2)

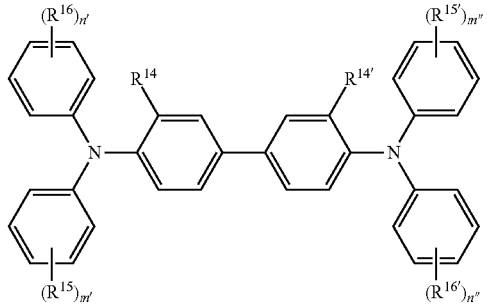

In the structural formula (a-2), $R^{14}$ and $R^{14'}$ may be the same or different from each other, and each independently represent a hydrogen atom, a halogen atom, an alkyl group having from 1 to 5 carbon atoms, an alkoxy group having from 1 to 5 carbon atoms; $R^{15}$, $R^{15'}$, $R^{16}$ and $R^{16'}$ may be the same or different from each other, and each independently represent a hydrogen atom, a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{17})═C(R^{18})(R^{19})$ or $—CH═CH—CH═C(R^{20})(R^{21})$; $R^{17}$ to $R^{21}$ each independently represent a hydrogen atom, a substituted or unsubstituted alkyl group, or a substituted or unsubstituted aryl group; and m', m", n' and n" each independently represent an integer of from 0 to 2.

Herein, among the triarylamine derivatives represented by the structural formula (a-1) and the benzidine derivatives represented by the structural formula (a-2), particularly, triarylamine derivatives having "$—C_6H_4—CH═CH—CH═C(R^{12})(R^{13})$" and benzidine derivatives having "$—CH═CH—CH═C(R^{20})(R^{21})$" are preferable.

Examples of the binder resin used in the charge transporting layer 2B include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. In addition, as described above, polymer charge transporting materials may also be used as the binder resin, such as the polyester-based polymer charge transporting materials disclosed in JP-A-08-176293 and JP-A-08-208820. These binder resins may be used alone or in combination of two or more kinds thereof. The mixing ratio between the charge transporting material and the binder resin may be preferably from 10:1 to 1:5 by weight ratio.

The binder resin is not particularly limited, but it is preferable to use at least one kind selected from a polycarbonate resin having viscosity average molecular weight of from 50,000 to 80,000 and a polyarylate resin having a viscosity average molecular weight of from 50,000 to 80,000.

As the charge transporting material, a polymer charge transporting material may also be used. As the polymer charge transporting material, well-known materials having charge transport property such as poly-N-vinyl carbazole and polysilane may be used. Particularly, polyester-based polymer charge transporting materials disclosed in JP-A-08-176293 and JP-A-08-208820 are preferable. The polymer charge transporting materials may form a film alone, but may also be mixed with the above-described binder resin to form a film.

The charge transporting layer 2B is formed, for example, using coating liquid for forming a charge transporting layer which contains the above-described constituent materials. As a solvent used in the coating liquid for forming a charge transporting layer, common organic solvents, for example, aromatic hydrocarbon type solvents such as benzene, toluene, xylene, and chlorobenzene; ketone type solvents such as acetone and 2-butanone; halogenated aliphatic hydrocarbon solvents such as methylene chloride, chloroform, and ethylene chloride; and cyclic or straight chain ether type solvents such as tetrahydrofuran and ethyl ether are used alone or as a combination of two or more kinds thereof. In addition, as a method for dispersing the above-described constituent materials, a well-known method may be used.

As a coating method used in applying the coating liquid for forming a charge transporting layer onto the charge generating layer 2A, common methods such as a blade coating method, a wire bar coating method, a spray coating method, a dip coating method, a bead coating method, an air knife coating method, and a curtain coating method are used.

The film thickness of the charge transporting layer 2B is preferably from 5 μm to 50 μm and more preferably from 10 μm to 30 μm.

Surface Layer

The surface layer 5 contains at least a fluorine-containing resin and the polymer in which the charge transporting material is subjected to condensation polymerization.

Fluorine-Containing Resin

Examples of the fluorine-containing resin include a tetrafluoroethylene (PTFE) resin, a chlorotrifluoroethylene resin, a hexafluoropropene resin, a polyvinyl fluoride resin, a vinylidene fluoride resin, dichlorodifluoroethylene resin, and a copolymer thereof. Among these, one or two or more kinds thereof are selected and used. In addition, the tetrafluoroethylene resin and the vinylidene fluoride resin are more preferable and the tetrafluoroethylene resin is particularly preferable.

An average primary particle size of the fluorine-containing resin to be used is preferably from 0.05 μm to 1 μm and more preferably from 0.1 μm to 0.5 μm.

Moreover, the average primary particle size of the fluorine-containing resin refers to a value obtained by using a laser diffraction type particle size distribution analyzer LA-700 (manufactured by HORIBA, Ltd.), and measuring the measurement liquid prepared by diluting dispersion liquid having the fluorine-containing resin dispersed therein, with the same solvent, at a refractive index of 1.35.

The content of the fluorine-containing resin is preferably from 5% by weight to 12% by weight and more preferably from 7% by weight to 10% by weight, with respect to the total solid content of the surface layer.

Polymer in which Charge Transporting Material is Subjected to Condensation Polymerization As the charge transporting material to be subjected to condensation polymerization, a charge transporting material having at least one of reactive functional groups is exemplified and examples of the reactive functional groups include —OH, —$OCH_3$, —$NH_2$, —SH, and —COOH. The charge transporting material has preferably at least two of the reactive functional groups, and more preferably three or more thereof.

As the charge transporting material having a reactive functional group, the compound represented by the following Formula (I) is particularly preferable.

$$F—((—R^7—X)_{n1}(R^8)_{n3}—Y)_{n2} \quad (I)$$

In Formula (I), F represents an organic group derived from a compound having a hole-transporting ability; $R^7$ and $R^8$ each independently represent a linear or branched alkylene group having from 1 to 5 carbon atoms; n1 represents 0 or 1; n2 represents an integer of from 1 to 4; and n3 represents 0 or 1. X represents an oxygen atom, NH or a sulfur atom and Y represents —OH, —$OCH_3$, —$NH_2$, —SH or —COOH.

In Formula (I), as a compound having a hole-transporting ability in the organic group represented by F which is derived from a compound having a hole-transporting ability, an arylamine derivative is preferably exemplified. Preferable examples of the arylamine derivative include a triphenylamine derivative and tetraphenylbenzidine derivative.

It is more preferable that the compound represented by Formula (I) be the compound represented by the following Formula (II).

(II)

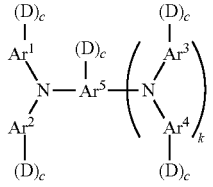

In Formula (II), $Ar^1$ to $Ar^4$ may be the same or different from each other and each independently represent a substituted or unsubstituted aryl group; $Ar^5$ represents a substituted or unsubstituted aryl group or a substituted or unsubstituted arylene group; D represents —(—$R^7$—X)$_{n1}$($R^8$)$_{n3}$—Y; c each independently represents 0 or 1; k represents 0 or 1; and the total number of D is from 1 to 4. In addition, $R^7$ and $R^8$ each independently represent a linear or branched alkylene group having from 1 to 5 carbon atoms; n1 represents 0 or 1; n3 represents 0 or 1; X represents an oxygen atom, NH or a sulfur atom; and Y represents —OH, —$OCH_3$, —$NH_2$, —SH or —COOH.

In Formula (II) "—(—$R^7$—X)$_{n1}$($R^8$)$_{n3}$—Y" represented by D is the same as that in Formula (I), and $R^7$ and $R^8$ each independently represent a linear or branched alkylene group having from 1 to 5 carbon atoms.

Further, particularly, n1 is preferably 0 and n3 is preferably 1. In this case, $R^8$ is preferably a methylene group, an ethylene group, and a propylene group and more preferably a methylene group. In addition, Y is more preferably —OH.

The total number of D in Formula (II) corresponds to n2 in Formula (I), is preferably from 2 to 4, and more preferably from 3 to 4. That is, in Formula (I) and Formula (II), it is preferable that preferably from 2 to 4, and more preferably from 3 to 4 reactive functional groups (—OH, —$OCH_3$, —$NH_2$, —SH or —COOH) be included in one molecule.

In Formula (II), $Ar^1$ to $Ar^4$ are preferably represented by any one of the following Formulae (1) to (7). In addition, the following Formulae (1) to (7) are shown together with "-$(D)_c$" which may be linked to $Ar^1$ to $Ar^4$ respectively.

(1)

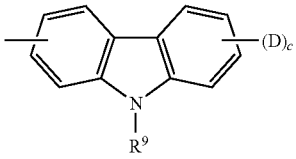

(2)

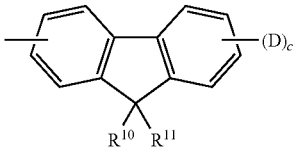

(3)

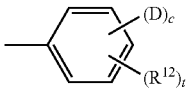

(4)

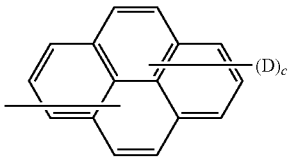

(5)

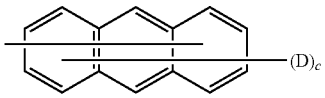

(6)

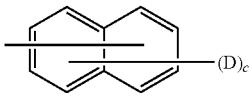

(7)

In Formulae (1) to (7), $R^9$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{10}$ to $R^{12}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c are the same as "D" and "c" in Formula (II); s each represents 0 or 1; and t represents an integer of from 1 to 3.

Herein, in Formula (7), Ar is preferably one represented by the following Formula (8) or (9).

(8)

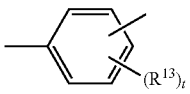

-continued (9)

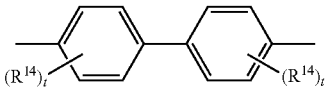

In Formulae (8) and (9), $R^{13}$ and $R^{14}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; and t represents an integer of from 1 to 3.

In Formula (7), Z' is preferably represented by any one of the following Formulae (10) to (17).

(10)

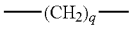

(11)

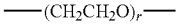

(12)

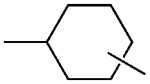

(13)

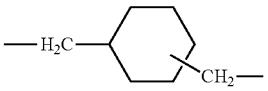

(14)

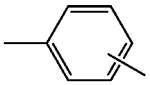

(15)

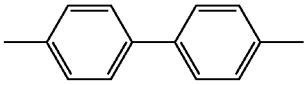

(16)

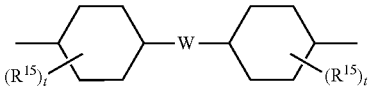

(17)

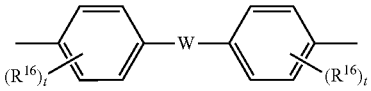

In Formulae (10) to (17), $R^{15}$ and $R^{16}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; W represents a divalent group; q and r each represent an integer of from 1 to 10; and t represents an integer of from 1 to 3.

In Formulae (16) and (17), W is preferably a divalent group represented by any one of the following Formulae (18) to (26). Here, in Formula (25), u represents an integer of from 0 to 3.

(18)

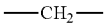

(19)

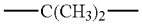

(20)

-continued

(21) —S—

(22) —$C(CF_3)_2$—

(23) —$Si(CH_3)_2$—

(24)

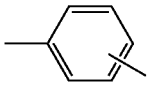

(25)

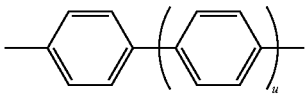

(26)

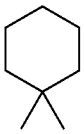

In Formula (II), when k is 0, $Ar^5$ is an aryl group of the above-described Formulae (1) to (7) as exemplified for $Ar^1$ to $Ar^4$, and when k is 1, $Ar^5$ is preferably an arylene group obtained by removing one hydrogen atom from the aryl group of the above-described Formulae (1) to (7).

Specific examples of the compound represented by Formula (I) include the following compounds. In addition, the compound represented by Formula (I) is not limited to the following compounds.

I-1

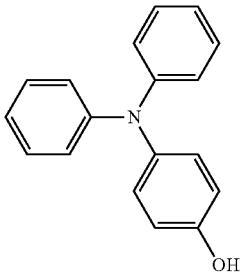

I-2

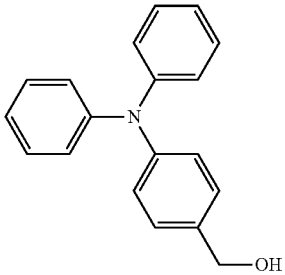

I-3

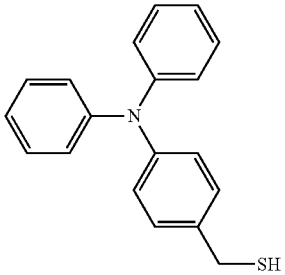

-continued

I-4

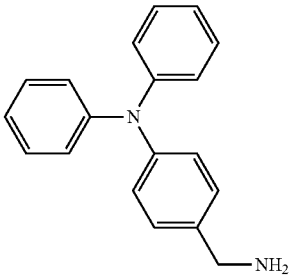

I-5

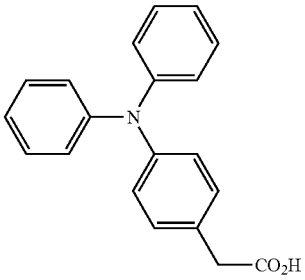

I-6

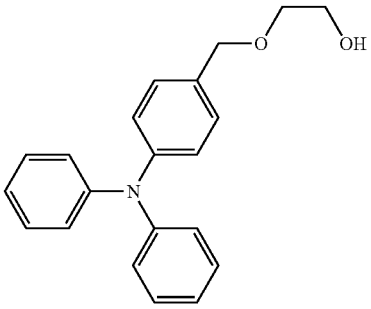

I-7

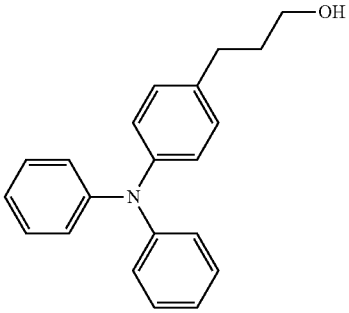

I-8

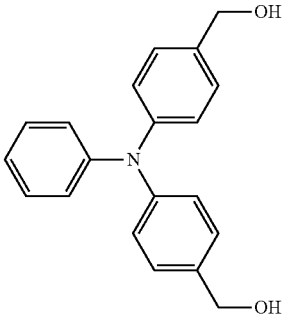

-continued
I-9
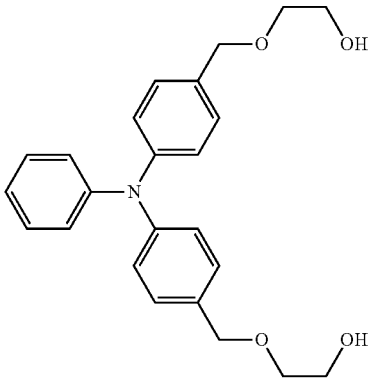
I-10
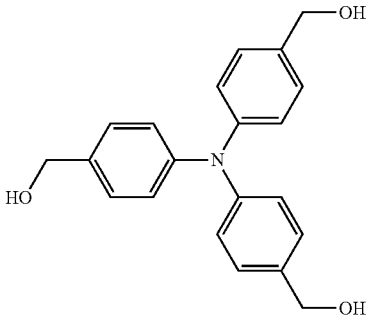
I-11
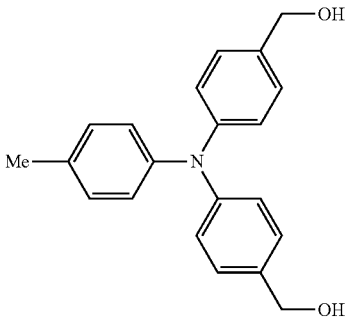
I-12
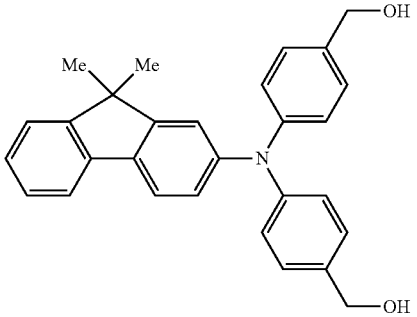
-continued
I-13
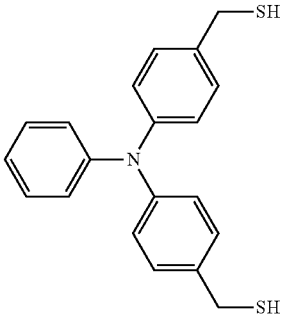
I-14
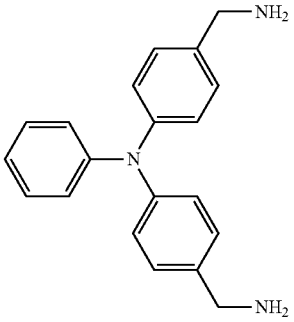
I-15
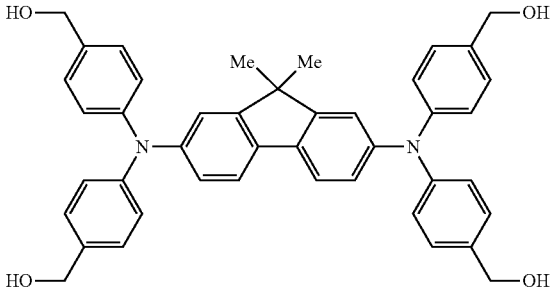
I-16
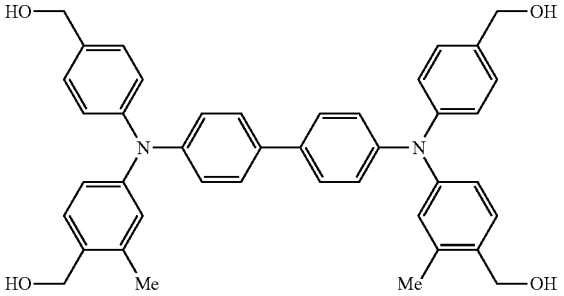
I-17
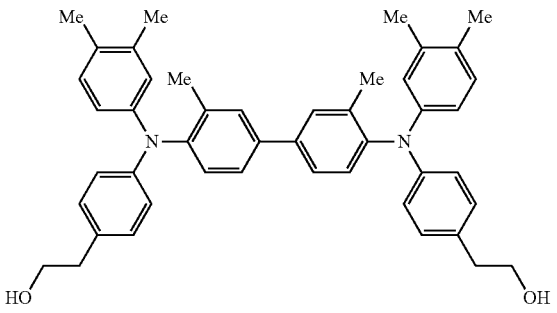

-continued
I-18
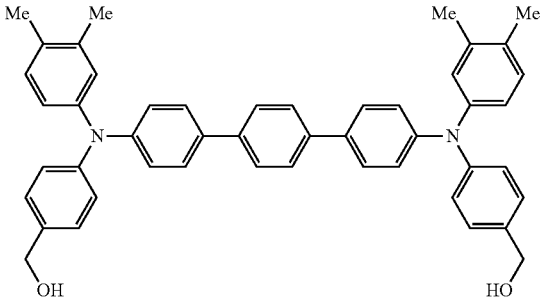
I-19
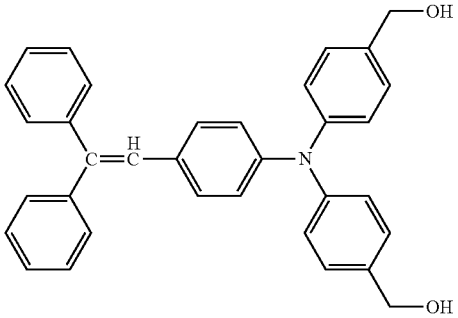
I-20
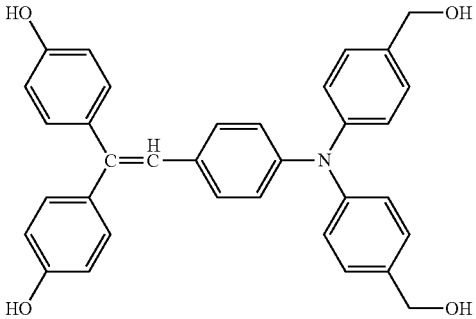
I-21
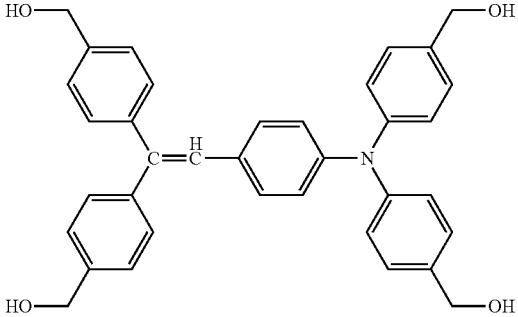
-continued
I-22
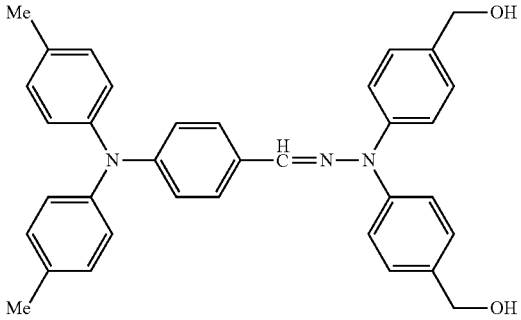
I-23
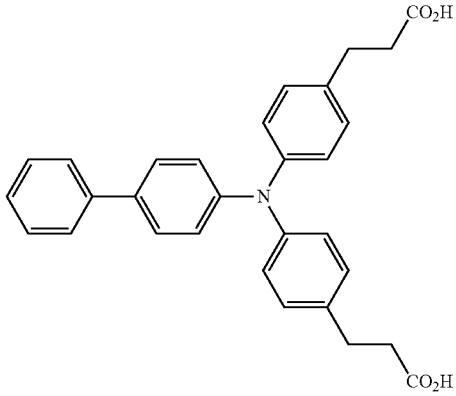
I-24
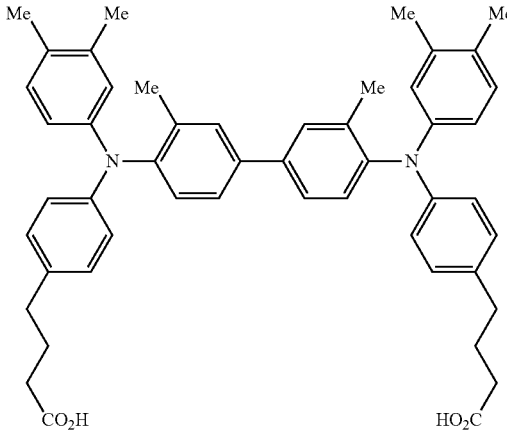
I-25
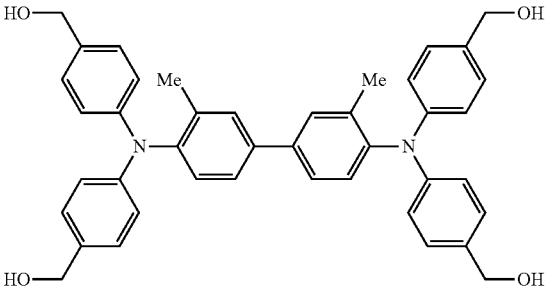

-continued

I-26

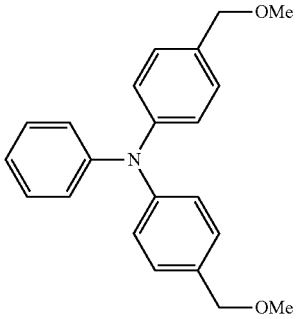

I-27

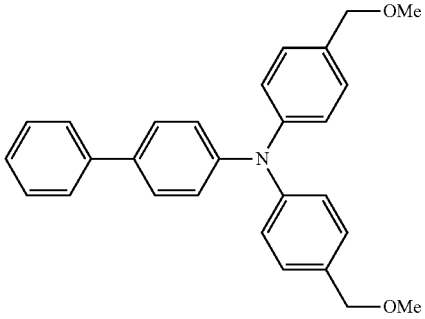

I-28

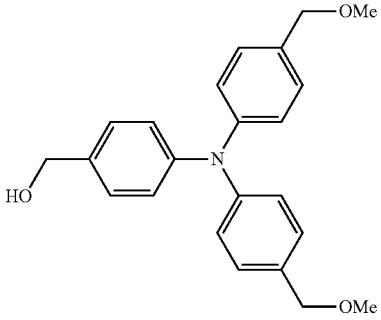

I-29

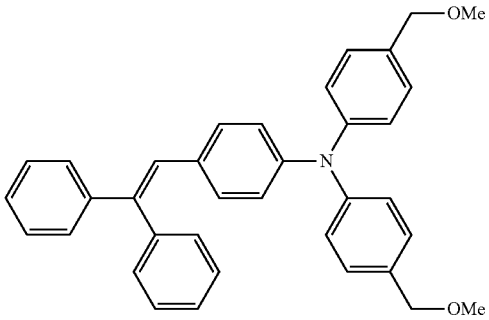

I-30

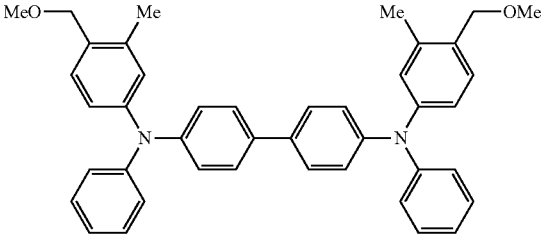

-continued

I-31

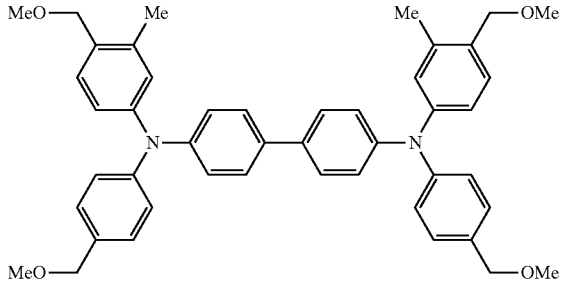

The content of the charge transporting material in the entire components (material remained as solid content) used in forming the surface layer is preferably 85% or more by weight. The upper limit thereof is preferably 98% or less by weight and more preferably from 90% by weight to 95% by weight.

Guanamine Compound and Melamine Compound

The polymer in which the charge transporting material is subjected to condensation polymerization may be a cross-linked polymer obtained by cross-linking with a compound having a guanamine structure or a melamine structure.

The compound having a guanamine structure (guanamine compound) is a compound having a guanamine skeleton and examples thereof include acetoguanamine, benzoguanamine, formoguanamine, steroguanamine, spiroguanamine and cyclohexylguanamine.

The guanamine compound is particularly preferably at least one of a compound represented by the following Formula (A) and multimers thereof. Herein, the multimers are oligomers obtained by polymerization of the compound represented by Formula (A) as a structural unit, and have a polymerization degree of, for example, from 2 to 200 (preferably from 2 to 100). The compound represented by Formula (A) may be used alone or as a combination of two or more kinds thereof.

Formula (A)

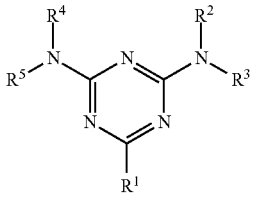

In Formula (A), $R^1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R^2$ to $R^5$ each independently represent a hydrogen atom, —$CH_2$—OH or —$CH_2$—O—$R^6$. $R^6$ represents a hydrogen atom, or a linear or branched alkyl group having from 1 to 10 carbon atoms.

In Formula (A), the alkyl group represented by $R^1$ has from 1 to 10 carbon atoms, preferably from 1 to 8 carbon atoms, and more preferably from 1 to 5 carbon atoms. In addition, the alkyl group may be linear or branched.

In Formula (A), the phenyl group represented by $R^1$ has from 6 to 10 carbon atoms, and more preferably from 6 to 8 carbon atoms. Examples of the substituent which is substituted to the phenyl group include a methyl group, an ethyl group, and a propyl group.

In Formula (A), the alicyclic hydrocarbon group represented by $R^1$ has from 4 to 10 carbon atoms, and more preferably from 5 to 8 carbon atoms. Examples of the substituent which is substituted to the alicyclic hydrocarbon group include a methyl group, an ethyl group, and a propyl group.

In "—$CH_2$—O—$R^6$" represented by $R^2$ to $R^5$ in Formula (A), the alkyl group represented by $R^6$ has from 1 to 10 carbon atoms, preferably from 1 to 8 carbon atoms, and more preferably from 1 to 6 carbon atoms. In addition, the alkyl group may be linear or branched. Preferable examples of the alkyl group include a methyl group, an ethyl group, and a butyl group.

The compound represented by Formula (A) is particularly preferably a compound in which $R^1$ represents a substituted or unsubstituted phenyl group having from 6 to 10 carbon atoms and $R^2$ to $R^5$ each independently represent —$CH_2$—O—$R^6$. In addition, $R^6$ is preferably selected from a methyl group and an n-butyl group.

The compound represented by Formula (A) is synthesized from, for example, guanamine and formaldehyde according to a known method (for example, referring to Jikken Kagaku Koza, the 4th edition, Vol 28, p. 430).

Hereinafter, specific examples of the compound represented by Formula (A) are shown but not limited thereto. In addition, the following specific examples are shown in the form of a monomer, but the compound may be in the form of a multimer (oligomer) in which the monomer is used as a structural unit.

(A)-1

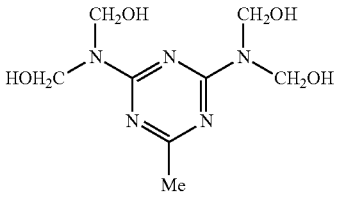

(A)-2

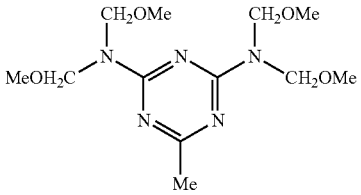

(A)-3

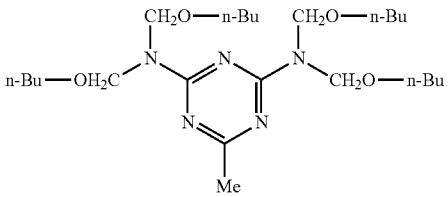

(A)-4

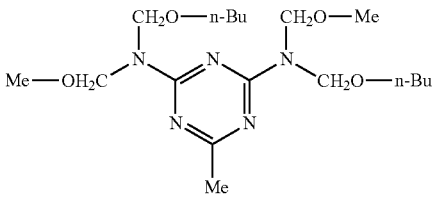

-continued (A)-5

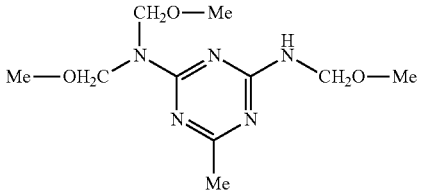

(A)-6

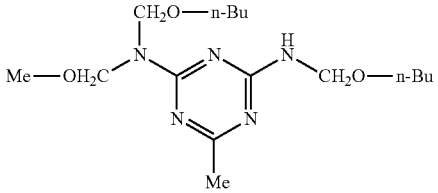

(A)-7

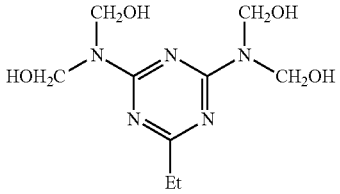

(A)-8

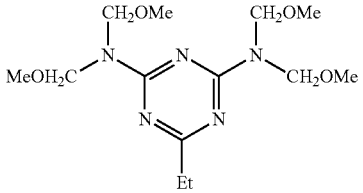

(A)-9

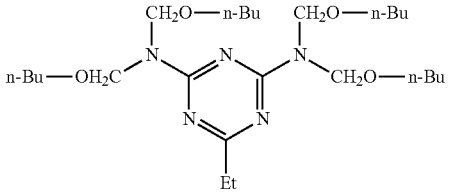

(A)-10

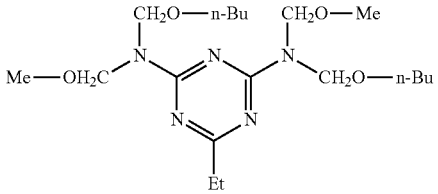

(A)-11

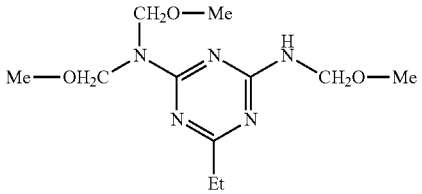

(A)-12

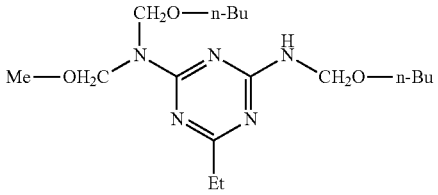

-continued
(A)-13
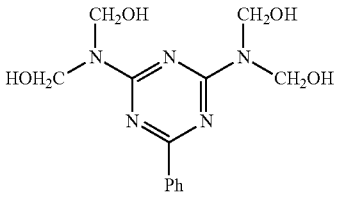
(A)-14
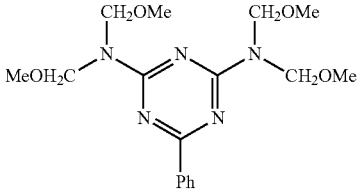
(A)-15
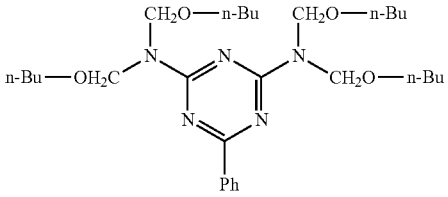
(A)-16
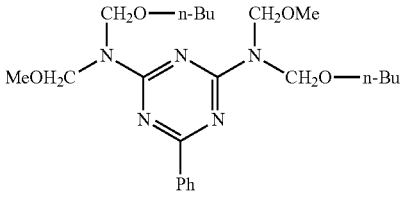
(A)-17
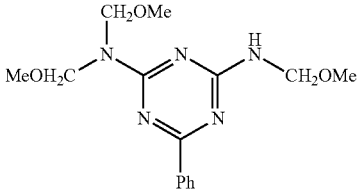
(A)-18
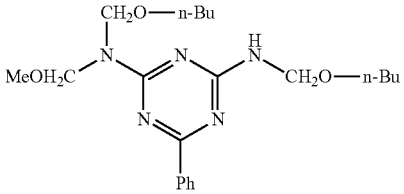
(A)-19
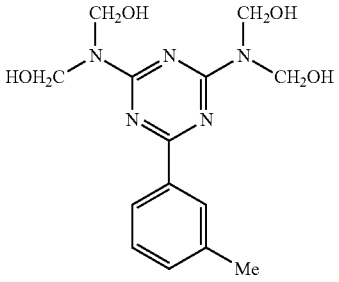
-continued
(A)-20
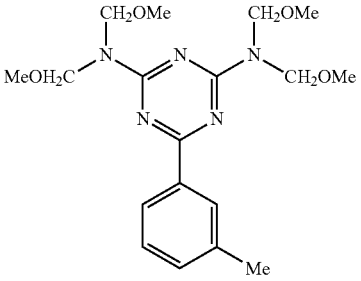
(A)-21
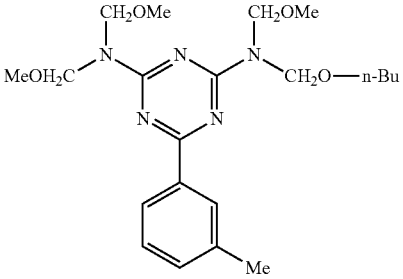
(A)-22
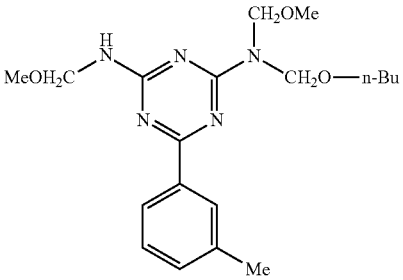
(A)-23
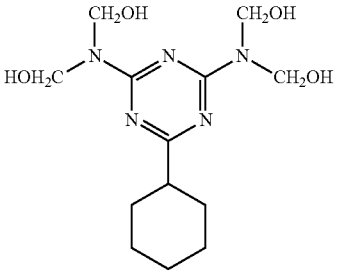
(A)-24
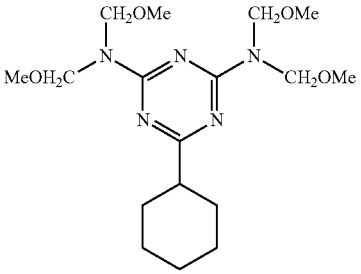

-continued
(A)-25
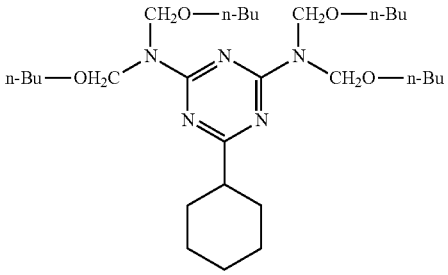
(A)-26
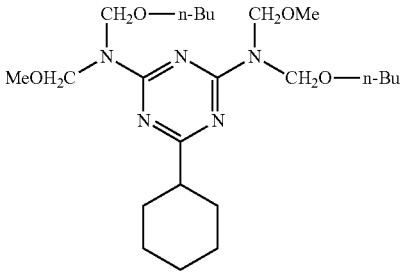
(A)-27
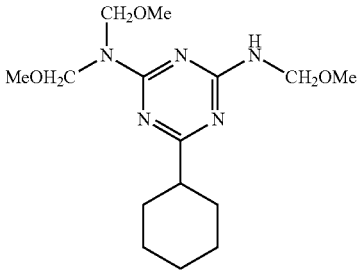
(A)-28
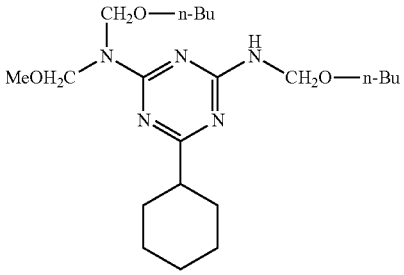
(A)-29
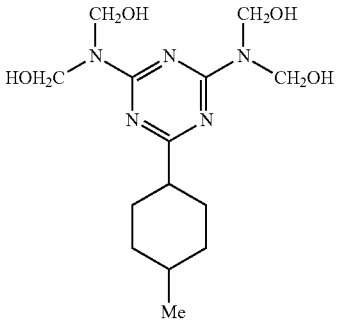
-continued
(A)-30
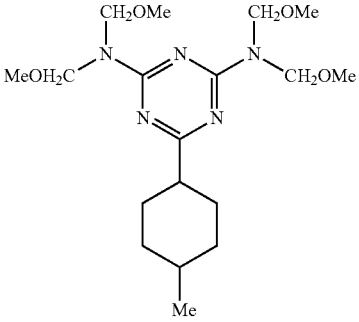
(A)-31
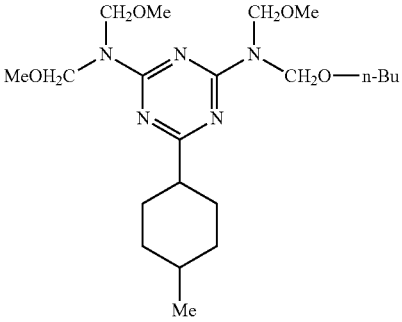
(A)-32
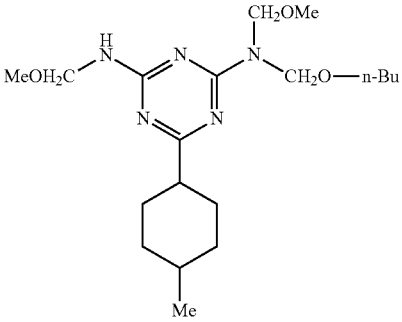
(A)-33
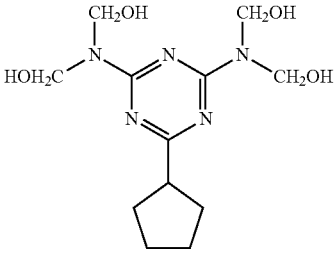
(A)-34
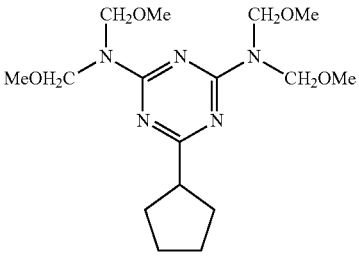

-continued (A)-35

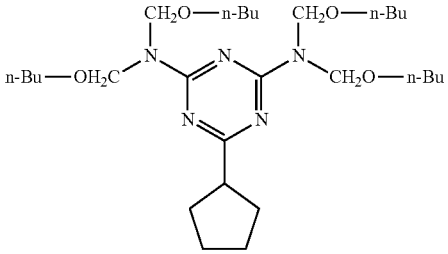

(A)-36

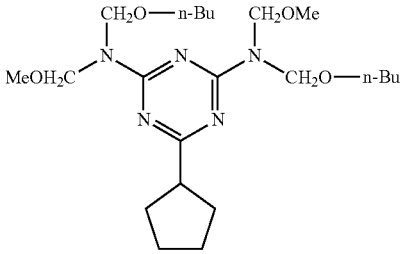

(A)-37

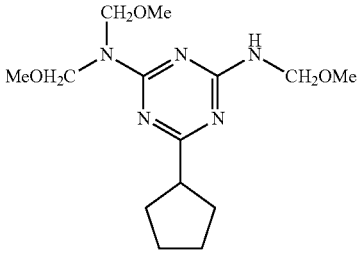

(A)-38

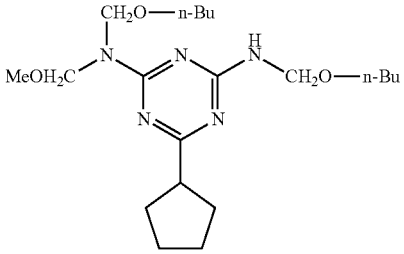

(A)-39

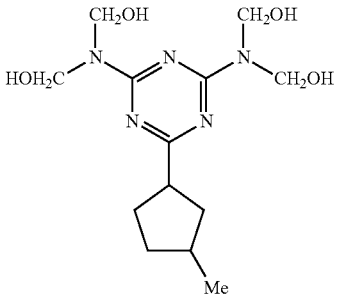

(A)-40

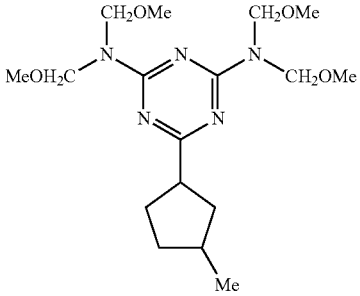

-continued (A)-41

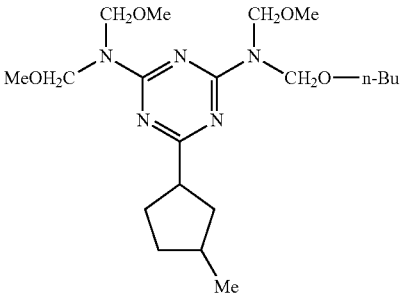

(A)-42

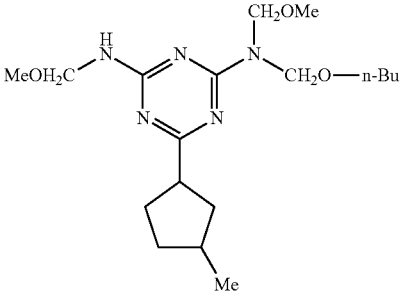

Examples of commercial products of the compound represented by Formula (A) include "SUPER BECKAMIN® L-148-55, SUPER BECKAMIN® 13-535, SUPER BECKAMIN® L-145-60, and SUPER BECKAMIN® TD-126" (manufactured by DIC Corporation), and "NIKALACK BL-60 and NIKALACK BX-4000" (manufactured by Sanwa Chemical Co., Ltd.).

After the compound represented by Formula (A) (including multimers) is synthesized or purchased, in order to remove the influence of the residual catalyst, the compound may be dissolved in an appropriate solvent such as toluene, xylene or ethyl acetate, followed by washing with distilled water or ion exchange water, or treatment with ion exchange resin.

Next, the compound having a melamine structure (melamine compound) is particularly preferably at least one of a compound represented by the following Formula (B) and multimers thereof. Herein, similarly to Formula (A), the multimers are oligomers obtained by polymerization of the compound represented by Formula (B) as a structural unit, and have a polymerization degree of, for example, from 2 to 200 (preferably from 2 to 100). The compound represented by Formula (B) or multimers thereof may be used alone or as a combination of two or more kinds thereof, or may be used in combination with the compound represented by Formula (A) or a multimer thereof.

Formula (B)

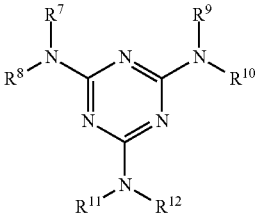

In Formula (B), $R^7$ to $R^{12}$ each independently represent a hydrogen atom, —$CH_2$—OH, or —$CH_2$—O—$R^{13}$. $R^{13}$ is an alkyl group having from 1 to 5 carbon atoms which may be branched. Examples of $R^{13}$ include a methyl group, an ethyl group, and a butyl group.

The compound represented by Formula (B) is synthesized from, for example, melamine and formaldehyde according to a known method (for example, synthesized in a similar manner to the melamine resin described in Jikken Kagaku Koza, the 4th edition, Vol 28, p. 430).

Hereinafter, specific examples of the compound represented by Formula (B) are shown but not limited thereto. In addition, the following specific examples are shown in the form of a monomer, but the compound may be in the form of a multimer (oligomer) in which the monomer is used as a structural unit.

(B)-1

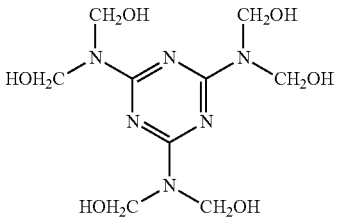

(B)-2

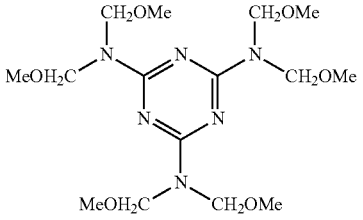

(B)-3

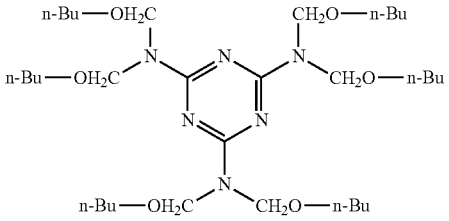

(B)-4

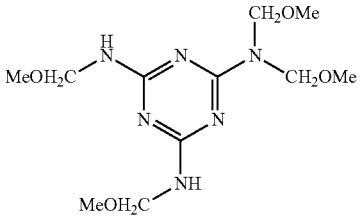

(B)-5

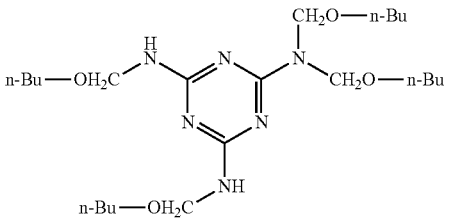

-continued (B)-6

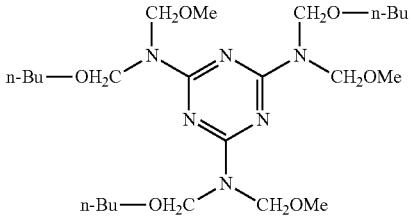

(B)-7

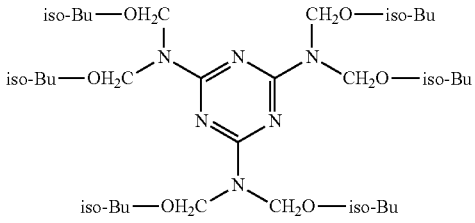

Examples of commercial products of the compound represented by Formula (B) include SUPERMERAMI No. 90 (manufactured by NOF CORPORATION), SUPER BECKAMINE ® TD-139-60 (manufactured by DIC Corporation), YUBAN 2020 (manufactured by Mitsui Chemicals, Inc.), SUMITEX RESIN M-3 (manufactured by Sumitomo Chemical co., Ltd.) and NIKALAC MW-30 (manufactured by Sanwa Chemical Co., Ltd.).

After the compound represented by Formula (B) (including multimers) is synthesized or purchased, in order to remove the influence of the residual catalyst, the compound may be dissolved in an appropriate solvent such as toluene, xylene or ethyl acetate, followed by washing with distilled water or ion exchange water, or treatment with ion exchange resin.

Other Components

In the surface layer 5, thermosetting resins such as phenolic resin, melamine resin, urea resin, alkyd resin, and benzoguanamine resin may be used. In addition, a compound having more functional groups in one molecule, such as a spiroacetal-based guanamine resin (for example, "CTU-GUANAMINE" (manufactured by Ajinomoto Fine Techno Co., Inc.)), may also be copolymerized with the materials in the cross-linked product.

A surfactant may be added to the surface layer 5. As the surfactant used, a surfactant, which contains a fluorine atom and at least one kind of an alkylene oxide structure and a silicone structure, is preferably exemplified.

An antioxidant may be added to the surface layer 5. As the antioxidant, a hindered phenol antioxidant or a hindered amine antioxidant is preferable and well-known antioxidants such as an organic sulfur antioxidant, a phosphite antioxidant, a dithiocarbamic acid salt antioxidant, a thiourea antioxidant, or a benzimidazole antioxidant may be used. The amount of the antioxidant added is preferably 20% or less by weight, and more preferably 10% or less by weight.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol) 2,2-methylenebis(4-ethyl-6-t-butylphenol), 4,4'-butylidenebis(3-methyl-6-t-butylphenol) 2,5-di-t-amylhydroquinone, 2-t-butyl-6-(3-butyl-2-hydroxy-5-methylbenzyl)-4-methylphenylacrylate, and 4,4'-butylidenebis(3-methyl-6-t-butylphenol)

A curing catalyst for promoting the curing of the charge transporting material or the guanamine compound and the melamine compound may be incorporated into the surface layer 5. As the curing catalyst, an acid-based catalyst is preferably used. Examples of the acid-based catalyst include aliphatic carboxylic acid such as acetic acid, chloroacetic acid, trichloroacetic acid, trifluoroacetic acid, oxalic acid, maleic acid, malonic acid, or lactic acid; aromatic carboxylic acid such as benzoic acid, phthalic acid, terephthalic acid or trimellitic acid; and aliphatic and aromatic sulfonic acids such as methanesulfonic acid, dodecylsulfonic acid, benzenesulfonic acid, dodecylbenzenesulfonic acid, or naphthalenesulfonic acid. However, it is preferable to use a sulfur-containing material.

It is preferable that the sulfur-containing material as the curing catalyst exhibit acidity at normal temperature (for example, 25° C.) or after heating, and at least one of organic sulfonic acids and derivatives thereof is most preferable. The presence of these catalysts in the surface layer 5 is easily confirmed by an energy dispersive X-ray analysis (EDS), an x-ray photoelectron spectroscopic method (XPS), or the like.

Examples of the organic sulfonic acids or derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid. Among these, p-toluenesulfonic acid and dodecylbenzenesulfonic acid are preferable. In addition, a salt of organic sulfonic acid may be used, as long as it is dissociable in a curable resin composition.

In addition, a so-called thermal latent catalyst, which acquires higher catalytic capacity when heat is applied, may be used.

Examples of the thermal latent catalyst include particulate microcapsules obtained by coating an organic sulfone compound or the like with a polymer; porous compounds such as zeolite onto which an acid is adsorbed; heat latent protonic acid catalysts in which a protonic acid or a derivative thereof is blocked with a base; a protonic acid or a derivative thereof esterified with a primary or secondary alcohol; a protonic acid or a derivative thereof blocked with vinyl ethers or vinyl thioethers; monoethyl amine complexes of boron trifluoride; and pyridine complexes of boron trifluoride.

Among these, protonic acid or a derivative of protonic acid that is blocked with a base is preferably used.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acid, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. In addition, examples of the protonic acid derivatives include neutralized alkali metal salts or alkaline earth metal salts of protonic acids such as sulfonic acid and phosphoric acid, and a polymer compound in which a protonic acid skeleton is incorporated into a polymer chain thereof (for example, polyvinylsulfonic acid). Examples of the base that blocks the protonic acid include amines.

The amines are classified into primary, secondary, and tertiary amines. In the present invention, any one of these amines may be used without particular restriction.

Examples of the primary amine include methylamine, ethylamine, propylamine, isopropylamine, n-butylamine, isobutylamine, t-butylamine, hexylamine, 2-ethylhexylamine, sec-butylamine, allylamine, and methylhexylamine.

Examples of the secondary amine include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amine include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of the commercial products include "NACURE 2501" (toluenesulfonic acid dissociation, methanol/isopropanol solvent, from pH 6.0 to pH 7.2, dissociation temperature 80° C.), "NACURE 2107" (p-toluenesulfonic acid dissociation, isopropanol solvent, from pH 8.0 to pH 9.0, dissociation temperature 90° C.), "NACURE 2500" (p-toluenesulfonic acid dissociation, isopropanol solvent, from pH 6.0 to pH 7.0, dissociation temperature 65° C.), "NACURE 2530" (p-toluenesulfonic acid dissociation, methanol/isopropanol solvent, from pH 5.7 to pH 6.5, dissociation temperature 65° C.), "NACURE 2547"(p-toluenesulfonic acid dissociation, aqueous solution, from pH 8.0 to pH 9.0, dissociation temperature 107° C.), "NACURE 2558" (p-toluenesulfonic acid dissociation, ethylene glycol solvent, from pH 3.5 to pH 4.5, dissociation temperature 80° C.), "NACURE XP-357" (p-toluenesulfonic acid dissociation, methanol solvent, from pH 2.0 to pH 4.0, dissociation temperature 65° C.), "NACURE XP-386" (p-toluenesulfonic acid dissociation, aqueous solution, from pH 6.1 to pH 6.4, dissociation temperature 80° C.), "NACURE XC-2211" (p-toluenesulfonic acid dissociation, from pH 7.2 to pH 8.5, dissociation temperature 80° C.), "NACURE 5225 (dodecylbenzenesulfonic acid dissociation, isopropanol solvent, from pH 6.0 to pH 7.0, dissociation temperature 120° C.), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, from pH 7.0 to pH 8.0, dissociation temperature 120° C.), "NACURE 5925" (dodecylbenzenesulfonic acid dissociation, from pH 7.0 to pH 7.5, dissociation temperature 130° C.), "NACURE 1323" (dinonylnaphthalenesulfonic acid dissociation, xylene solvent, from pH 6.8 to pH 7.5, dissociation temperature 150° C.), "NACURE 1419" (dinonylnaphthalenesulfonic acid dissociation, xylene/methyl isobutyl ketone solvent, dissociation temperature 150° C.), "NACURE 1557" (dinonylnaphthalenesulfonic acid dissociation, butanol/2-butoxyethanol solvent, from pH 6.5 to pH 7.5, dissociation temperature 150° C.), "NACURE X49-110" (dinonylnaphthalenedisulfonic acid dissociation, isobutanol/isopropanol solvent, from pH 6.5 to pH 7.5, dissociation temperature 90° C.), "NACURE 3525" (dinonylnaphthalenedisulfonic acid dissociation, isobutanol/isopropanol solvent, from pH 7.0 to pH 8.5, dissociation temperature 120° C.), "NACURE XP-383" (dinonylnaphthalenedisulfonic acid dissociation, xylene solvent, dissociation temperature 120° C.), "NACURE 3327" (dinonylnaphthalenedisulfonic acid dissociation, isobutanol/isopropanol solvent, from pH 6.5 to pH 7.5, dissociation temperature 150° C.), "NACURE 4167" (phosphoric acid dissociation, isopropanol/isobutanol solvent, from pH 6.8 to pH 7.3, dissociation temperature 80° C.), "NACURE XP-297" (phosphoric acid dissociation, water/isopropanol solvent, from pH 6.5 to pH 7.5, dissociation temperature 90° C.), and "NACURE 4575" (phosphoric acid dissociation, from pH 7.0 to pH 8.0, dissociation temperature 110° C.), manufactured by King Industries, Inc.

The thermal latent catalysts may be used alone or in combination of two or more kinds thereof.

Herein, the mixing amount of the catalyst is preferably in the range of from 0.1% by weight to 10% by weight, and particularly preferably from 0.1 by weight to 5% by weight, with respect to the total solid content in the coating liquid, excluding the fluorine-containing resin.

Method for Forming Surface Layer

The surface layer 5 is formed through a coating process in which coating liquid for forming a surface layer that contains the above-described each component in a solvent is prepared and a coating film is formed by applying the coating liquid and a heating process in which, by heating the coating film, at least a charge transporting material is subjected to condensation polymerization so as to form a polymer and the solvent is removed by heating.

Examples of the solvent used in the coating liquid for a surface layer include alicyclic ketone compounds such as cyclobutanone, cyclopentanone, cyclohexanone, and cycloheptanone; cyclic or liner alcohols such as methanol, ethanol, propanol, butanol, and cyclopentanol; linear ketones such as acetone and methyl ethyl ketone; cyclic or linear ethers such as tetrahydrofuran, dioxane, ethylene glycol, and diethyl ether; halogenated aliphatic hydrocarbons such as methylene chloride, chloroform, and ethylene chloride. The solvent may be used alone or as a combination of two or more kinds thereof.

In the heating process, for example, by heating at the temperature of from 100° C. to 170° C. for from 30 minutes to 60 minutes, the charge transporting material having the reactive functional group is subjected to condensation polymerization. Moreover, when the guanamine compound or the melamine compound is added, the cross-linking polymerization proceeds to form a polymer, and the solvent is removed, thereby obtaining the surface layer 5.

Operation

Next, the operation of the image forming apparatus according to the exemplary embodiment will be described.

In the image forming apparatus shown in FIG. 3, first, when monochrome toner images corresponding to the respective colors are formed by the respective image forming engines 22 (22*a* to 22*d*), the monochrome toner images of the respective colors are successively overlaid and primarily transferred on the surface of the intermediate transfer belt 230 so as to conform the images with the original document information. Subsequently, the color toner images transferred on the surface of the intermediate transfer belt 230 are transferred to the surface of a recording medium by the secondary transfer unit 52 and the recording medium to which the color toner images are transferred is subjected to fixing treatment by the fixing apparatus 66 and then discharged to the discharge unit 68.

On the other hand, in the respective image forming engines 22 (22*a* to 22*d*), the residual toner on the photoreceptor drum 31 is cleaned out by the cleaning device 34.

In the exemplary embodiment, since the above-described movement distance in a state where the cleaning blade 342 in the cleaning device 34 is brought into contact with the image holding member 31 is controlled in the above-described range, the abrasion of the cleaning blade is effectively suppressed.

EXAMPLES

The present invention will be described below based on examples, but the present invention is not limited to the following examples. In the following description, "part(s)" represents "part(s) by weight".

Example 1

Cleaning Blade A1

A cleaning blade A1 having a shape as shown in FIG. 6 that includes a contact member (edge member) and a non-contact member (rear face member) is prepared by a two-color molding method.

Preparation of Mold

First, a first die having a cavity (a region into which a composition for forming a contact member is injected) corresponding to a shape, in which the belly faces of two contact members (edge members) are overlapped, and a second die having a cavity corresponding to a shape, in which the belly faces of two of the contact member and the non-contact member (rear face member) are overlapped, are prepared.

Formation of Contact Member (Edge Member)

At first, polycaprolactone polyol (manufactured by Daicel Chemical Industries, Ltd., Placcel 205, average molecular weight: 529, hydroxyl value: 212 KOHmg/g) and polycaprolactone polyol (manufactured by Daicel Chemical Industries, Ltd., Placcel 240, average molecular weight: 4,155, hydroxyl value: 27 KOHmg/g) are used as soft segment materials containing polyol components. In addition, an acrylic resin containing two or more hydroxyl groups (manufactured by Soken Chemical Engineering Co., Ltd., Actflow UMB-2005B) is used as a hard segment material. The soft segment materials and the hard segment material are mixed at the ratio of 8:2 (weight ratio).

Next, 6.26 parts of 4,4'-diphenylmethane diisocyanate (manufactured by Nippon Polyurethane Industry Co., Ltd., Millionate Mont.), as an isocyanate compounds, is added to 100 parts of the mixture of the soft segment materials and the hard segment material and reaction is carried out at 70° C. for 3 hours under a nitrogen atmosphere. Moreover, the amount of the isocyanate compound used in this reaction is selected so as to adjust the ratio (isocyanate group/hydroxyl group) of the isocyanate groups to the hydroxyl groups contained in the reaction system to be 0.5.

Subsequently, 34.3 parts of the above-described isocyanate compound is further added and reaction is carried out at 70° C. for 3 hours under a nitrogen atmosphere to obtain a prepolymer. Moreover, the total amount of the isocyanate compound used at the time of using the prepolymer is 40.56 parts.

Next, the temperature of the prepolymer is raised to 100° C. and defoamed for 1 hour in reduced pressure. Thereafter, 7.14 parts of a mixture of 1,4-butanediol and trimethylolpropane (weight ratio=60/40) is added to 100 parts of the prepolymer, followed by mixing for 3 minutes without entraining foams therein. Thus, a composition A1 for forming a contact member is prepared.

Next, the composition A1 for forming a contact member is injected into a centrifugal molding apparatus in which the first die is adjusted to be at 140° C. and then curing reaction is carried out for 1 hour. Subsequently, by performing cross-linking at 110° C. for 24 hours and cooling, a first molded product having a shape in which two contact members (edge members) are overlapped is formed.

Formation of Non-contact Member (Rear Face Member)

Diphenylmethane-4,4-diisocyanate is mixed with the dehydration treated polytetramethyl ether glycol and reaction is carried out at 120° C. for 15 minutes. The obtained prepolymer in combination with 1,4-butanediol and trimethylolpropane as a curing agent is used as a composition A1 for forming a non-contact member.

Next, the second die is installed to the centrifugal molding apparatus such that the first molded product is disposed inside the cavity of the second die. Thereafter, the composition A1 for forming a non-contact member is injected into the cavity of the second die which is adjusted to be at 120° C. such that the first molded product is covered therewith and then curing reaction is carried out for 0.5 hour. Thus, a second molded product having a shape in which two belly faces of the contact member (edge member) and the non-contact member (rear face member) are overlapped to each other is formed.

After forming the second molded product, the second molded product is cooled after cross-linking at 110° C. for 24 hours. Subsequently, the cross-linked second molded product is cut at a portion to be a belly face and the cut second molded product is further cut into a dimension with a length of 8 mm and a thickness of 2 mm. Thus, a cleaning blade A1 is obtained.

Preparation of Photoreceptor A1

Undercoat Layer 100 parts of zinc oxide (average particle size: 70 nm, manufactured by Tayca Corporation: specific surface area value 15 $m^2/g$) is mixed under stirring with 500 parts of toluene, and 1.25 parts of the silane coupling agent (KBM 603, manufactured by Shin-Etsu Chemical Co., Ltd.) is added to the mixture. The mixture is stirred for 2 hours. Thereafter, the toluene is distilled off under reduced pressure, and the residue is baked at 120° C. for 3 hours. Thus, the zinc oxide is subjected to the surface treatment using the silane coupling agent.

100 parts of the surface treated zinc oxide is mixed under stirring with 500 parts of tetrahydrofuran. A solution prepared by dissolving 1 part of alizarin in 50 parts of tetrahydrofuran is added to the mixture, followed by stirring at 50° C. for 5 hours. Thereafter, the zinc oxide, to which alizarin is applied, is separated by filtration under reduced pressure and is dried under reduced pressure at 60° C. Thus, an alizarin-applied zinc oxide pigment is obtained.

A solution is prepared by dissolving 60 parts of the alizarin-applied zinc oxide pigment, 13.5 parts of blocked isocyanate (SUMIJUR 3175, manufactured by Sumitomo Bayer Urethane Co., Ltd.) as a curing agent, and 15 parts of a butyral resin (S-LEC BM-1, manufactured by Sekisui Chemical Co., Ltd.) in 85 parts of methyl ethyl ketone. 38 parts of the solution and 25 parts of methyl ethyl ketone are mixed, and the mixture is dispersed for 2 hours in a sand mill using glass beads having a diameter of 1 mm. Thus, dispersion liquid is obtained.

0.005 part of dioctyltin dilaurate as a catalyst and 40 parts of silicone resin particles (TOSPEARL 145, manufactured by GE Toshiba Silicones Co., Ltd.) are added to the obtained dispersion liquid and the resulting liquid is dried and cured at 170° C. for 40 minutes, thereby obtaining coating liquid for an undercoat layer.

The coating liquid for an undercoat layer is applied by dip coating onto an aluminum base material having a diameter of 30 mm and a length of 404 mm, using a dip coating method. Thus, an undercoat layer having a thickness of 21 μm is formed.

Charge Generating Layer

Next, a mixture of 1 part of chlorogallium phthalocyanine crystals having strong diffraction peaks at Bragg's angles (2θ±0.2°) of 7.4°, 16.6°, 25.5° and 28.3° in the X-ray diffraction spectrum as a charge generating material, and 1 part of a polyvinyl butyral resin (trade name: S-LEC BM-S, manufactured by Sekisui Chemical Co., Ltd.) are added to 100 parts of butyl acetate, and the mixture is dispersed by treating the mixture for 1 hour with a paint shaker together with glass beads. Thus, coating liquid for a charge generating layer is obtained.

The coating liquid for a charge generating layer is applied by dip coating onto the surface of the undercoat layer, and is dried by heating at 100° C. for 10 minutes. Thus, a charge generating layer having a film thickness of 0.2 μm is formed.

Charge Transporting Layer 2 parts of the charge transporting material A1 represented by the following formula and 3 parts of the polymer compound represented by the following structural formula 1 (viscosity average molecular weight: 39,000) are dissolved in 10 parts of tetrahydrofuran and 5 parts of toluene and thus coating liquid for a charge transporting layer is obtained.

The coating liquid for a charge transporting layer is applied by dip coating onto the surface of the charge generating layer, and is dried by heating at 135° C. for 35 minutes. Thus, a charge transporting layer having a film thickness of 22 μm is formed.

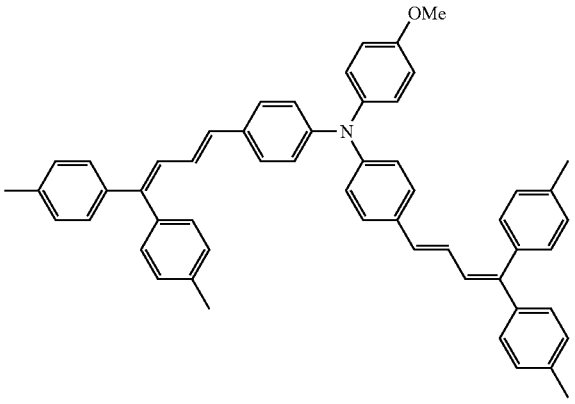

Charge transporting material A1

Structural formula 1

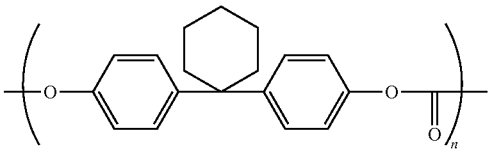

Surface Layer 0.1 part of dispersant (trade name: GF-400, manufactured by TOAGOSEI CO., LTD.) is dissolved in 16 parts of cyclopentanone and then 12 parts of tetrafluoroethylene resin powder (trade name: Lubron L-2, manufactured by Daikin Industries, Ltd.) as the fluorine-containing resin is added thereto. The mixture is mixed under stirring and thus tetrafluoroethylene resin particle suspension liquid is prepared. Thereafter, 85 parts of a charge transporting material B1 represented by the following formula, 2.8 parts of the benzoguanamine resin (trade name: NIKALAC BL-60, manufactured by Sanwa Chemical Co., Ltd.), and 0.1 part of NACURE 5225 (manufactured by King Industries, Inc.) are added to 240 parts of cyclopentanone and thus coating liquid for forming a surface layer is prepared.

The coating liquid for forming a surface layer is applied onto the charge transporting layer by a dip coating method and dried at 155° C. for 40 minutes to form a surface layer having a film thickness of 6 μm, thereby obtaining a photoreceptor A1.

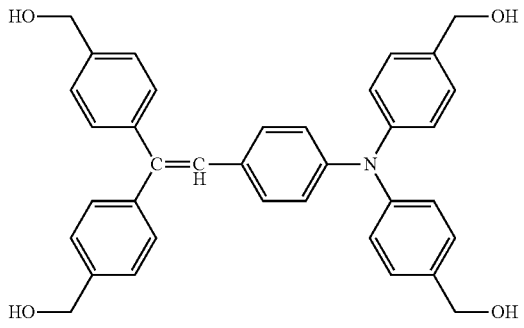

Charge transporting material B1

Physical Property of Cleaning Blade

Coefficient of kinetic friction of the contact member of the cleaning blade: 0.49

Young's modulus of the contact member of the cleaning blade: 28 MPa

Rebound resilience at 25° C. of the non-contact member of the cleaning blade: 40%

JIS A hardness of the contact member of the cleaning blade: 93°

JIS A hardness of the non-contact member of the cleaning blade: 63°

Free length of the cleaning blade: 7.5 mm

Thickness of the cleaning blade: 2 mm

Mounting to Image Forming Apparatus

Using DocuCentre IV C5570 (manufactured by Fuji Xerox Co. Ltd.) as an image forming apparatus, the above-described photoreceptor A1 is installed as an image holding member of the image forming apparatus. Further, the cleaning blade A1 is mounted as a cleaning blade in the cleaning device for the photoreceptor. Moreover, the mounting condition of the cleaning blade A1 is as follows.

Force NF (Normal Force) when the cleaning blade is pressed to be brought into contact with the image holding member: 2.4 gf/mm Length of the cleaning blade biting into the image holding member: 1.2 mm Angle W/A (Working Angle) at the contact portion of the cleaning blade and the image holding member: 10.5°

Coefficient of kinetic friction between the cleaning blade and the image holding member: 0.6

Measurement of Movement Distance

Using the cleaning blade and the photoreceptor mounted to the image forming apparatus as described above, when the position of the contact corner portion in a state where the photoreceptor is stopped is set to be a standard, a movement distance of the contact corner portion in a state where the photoreceptor is driven is measured by the above-described method.

Evaluation Test: Occurrence of Abrasion

The test is carried out under high temperature and high humidity conditions (28° C., 85%) and the degree of abrasion occurring on the cleaning blade A1 after the test is observed. The tip end of the cleaning blade after printing 10,000 sheets of paper is observed by using an ultra-deep color 3D profile measuring microscope (VK-9500, manufactured by KEYENCE Corporation) so as to measure the degree of abrasion.

Examples 2, 3 and Comparative Example 1

A cleaning blade is prepared by the method described in Example 1, except that the amount of the cross-linking agent in the contact member used in the preparation of the cleaning blade A1 of Example 1 is changed and the JIS A hardness and the Young's modulus of the contact member are adjusted as follows.

Moreover, the physical property of the cleaning blade is changed as follows.

Example 2

JIS A hardness of the contact member of the cleaning blade: 92°

Young's modulus of the contact member of the cleaning blade: 26 MPa

Example 3

JIS A hardness of the contact member of the cleaning blade: 87°

Young's modulus of the contact member of the cleaning blade: 16 MPa

Comparative Example 1

JIS A hardness of the contact member of the cleaning blade: 78°

Young's modulus of the contact member of the cleaning blade: 8 MPa

TABLE 1

| | Movement Distance [μm] | Abrasion Amount [$\mu m^2$] |
|---|---|---|
| Example 1 | 11.7 | 6.3 |
| Example 2 | 13.0 | 7.0 |
| Example 3 | 27.4 | 16.5 |
| Comparative Example 1 | 31.7 | 26.4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade for cleaning a surface of an image holding member, comprising:

a contact member that contacts the surface of the image holding member at a corner portion of a tip end of the cleaning blade, wherein, when the position of the corner portion in a state where the image holding member is stopped is set to be a standard, a movement distance of the cleaning blade to the position of the corner portion in a state where the image holding member is driven is from 10 μm to 30 μm, and wherein an endothermic peak top temperature of the contact member is 180° C. to 220° C.

2. The cleaning blade according to claim 1, wherein the cleaning blade comprises:

a contact member that forms a region including a portion contacting at least the image holding member and in which a coefficient of kinetic friction between the cleaning blade and the surface of the image holding member is from 0.4 to 1.2 and a Young's modulus is from 12 MPa to 28 MPa; and a non-contact member that forms a region other than the contact member and is formed of a different material from that of the contact member and in which rebound resilience at 25° C. is from 35% to 55%.

3. The cleaning blade according to claim 2, wherein the JIS A hardness of the non-contact member is lower than the JIS A hardness of the contact member.

4. The cleaning blade according to claim 2, wherein the Young's modulus of the contact member is from 15 MPa to 21 MPa.

5. The cleaning blade according to claim 2, wherein the coefficient of kinetic friction between the cleaning blade and the image holding member is from 0.6 to 0.8.

6. The cleaning blade according to claim 2, wherein the contact member is selected from polyurethane rubber, silicon rubber, fluorine rubber, chloroprene rubber, and butadiene rubber.

7. The cleaning blade according to claim 1, wherein the movement distance is from 10 μm to 15 μm.

8. The cleaning blade according to claim 1, which has a blade free length of from 6.0 mm to 8.0 mm.

9. The cleaning blade according to claim 1, which has a thickness of from 1.5 mm to 2.0 mm.

10. The cleaning blade according to claim 1, wherein the contact member is selected from polyurethane rubber, silicon rubber, fluorine rubber, chloroprene rubber, and butadiene rubber.

11. A process cartridge detachable from an image forming apparatus, the process cartridge comprising:

an image holding member on a surface of which a toner image is formed; and the cleaning blade according to claim 1.

12. The process cartridge according to claim 11, wherein the cleaning blade comprises:

a contact member that forms a region including a portion contacting at least the image holding member and in which a coefficient of kinetic friction between the cleaning blade and the surface of the image holding member is from 0.4 to 1.2 and a Young's modulus is from 12 MPa to 28 MPa; and a non-contact member that forms a region other than the contact member and is formed of a different material from that of the contact member and in which rebound resilience at 25° C. is from 35% to 55%.

13. The process cartridge according to claim 12, wherein in the cleaning blade, the JIS A hardness of the non-contact member is lower than the JIS A hardness of the contact member.

14. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member using toner to form a toner image;

a primary transfer device that transfers the toner image formed on the image holding member to an intermediate transfer member;

a secondary transfer device that transfers the toner image that has been transferred to the intermediate transfer member to a recording medium; and the cleaning blade according to claim 1.

15. The image forming apparatus according to claim 14, wherein the cleaning blade comprises:

a contact member that forms a region including a portion contacting at least the image holding member and in which a coefficient of kinetic friction between the cleaning blade and the surface of the image holding member is from 0.4 to 1.2 and a Young's modulus is from 12 MPa to 28 MPa; and a non-contact member that forms a region other than the contact member and is formed of a different material from that of the contact member and in which rebound resilience at 25° C. is from 35% to 55%.

16. The image forming apparatus according to claim 15, wherein in the cleaning blade, the JIS A hardness of the non-contact member is lower than the JIS A hardness of the contact member.

17. The cleaning blade according to claim 1, wherein the contact member is polyurethane rubber containing a hard segment and a soft segment, and the average particle size of aggregates in the hard segment is from 5 μm to 20 μm.

18. The cleaning blade according to claim 1, wherein a weight ratio of the material configuring the hard segment is in a range of from 10% by weight to 30% by weight, with respect to a total weight of the hard segment material and the soft segment material.

* * * * *